US011340539B2

(12) United States Patent
Sato

(10) Patent No.: US 11,340,539 B2
(45) Date of Patent: May 24, 2022

(54) IMAGE FORMING APPARATUS

(71) Applicant: BROTHER KOGYO KABUSHIKI KAISHA, Nagoya (JP)

(72) Inventor: Shougo Sato, Seto (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/358,944

(22) Filed: Jun. 25, 2021

(65) Prior Publication Data

US 2022/0011691 A1 Jan. 13, 2022

(30) Foreign Application Priority Data

Jul. 8, 2020 (JP) ..... JP2020-117594

(51) Int. Cl.
*G03G 15/08* (2006.01)
*G03G 21/16* (2006.01)
*G03G 21/18* (2006.01)

(52) U.S. Cl.
CPC ..... *G03G 15/0886* (2013.01); *G03G 21/1647* (2013.01); *G03G 21/1676* (2013.01); *G03G 21/1821* (2013.01); *G03G 2215/0692* (2013.01); *G03G 2221/163* (2013.01)

(58) Field of Classification Search
CPC ..... G03G 15/0886; G03G 21/1647; G03G 21/1676; G03G 21/1821; G03G 21/1832; G03G 2215/067; G03G 2215/0692; G03G 2221/163; G03G 2221/1853
See application file for complete search history.

(56) References Cited

U.S. PATENT DOCUMENTS

| | | | | |
|---|---|---|---|---|
| 8,750,753 | B2 * | 6/2014 | Itabashi | G03G 21/1821 399/111 |
| 10,871,731 | B2 * | 12/2020 | Hayakawa | G03G 21/1647 |
| 2003/0039484 | A1 | 2/2003 | Naito et al. | |
| 2010/0247159 | A1 * | 9/2010 | Imai | G03G 15/0886 399/260 |
| 2010/0329734 | A1 * | 12/2010 | Hayakawa | G03G 15/0886 399/119 |
| 2017/0108800 | A1 * | 4/2017 | Sato | G03G 15/0886 |
| 2018/0373197 | A1 * | 12/2018 | Sato | G03G 21/1814 |
| 2019/0361384 | A1 * | 11/2019 | Sato | G03G 15/0886 |

FOREIGN PATENT DOCUMENTS

JP 2003-066815 A 3/2003

* cited by examiner

*Primary Examiner* — Sophia S Chen
(74) *Attorney, Agent, or Firm* — Kenealy Vaidya LLP

(57) ABSTRACT

An image forming apparatus includes a drum cartridge and a toner cartridge. The drum cartridge includes a photosensitive drum, a developing device, and a cushion member. The developing device includes a developing roller and a developing housing having a toner receiving port. The developing housing is movable with respect to the photosensitive drum. The toner cartridge includes a toner housing having a toner discharge port and a toner shutter. The toner shutter opens and closes the toner discharge port. The cushion member allows the developing housing to move with respect to the developing shutter in a state where the developing shutter is engaged with the toner cartridge.

22 Claims, 21 Drawing Sheets

IMAGE FORMING APPARATUS

CROSS-REFERENCE TO RELATED APPLICATIONS

This application is based upon and claims the benefit of priority from prior Japanese patent application No. 2020-117594, filed on Jul. 8, 2020, the entire contents of which are incorporated herein by reference.

TECHNICAL FIELD

The present disclosure relates to an image forming apparatus.

BACKGROUND ART

In related-art, an image forming apparatus includes a drum cartridge and a toner cartridge. The drum cartridge includes a photosensitive drum and a developing device. The developing device is capable of supplying toner to the photosensitive drum. The toner cartridge is capable of supplying the toner to the developing device in a state where the toner cartridge is mounted on the drum cartridge. The developing device includes a developing roller, a developing housing and a developing shutter. The developing housing supports the developing roller. The developing housing has a toner receiving port. In a state where the toner cartridge is mounted on the drum cartridge, the toner receiving port is capable of receiving the toner from the toner cartridge. The developing shutter opens and closes the toner receiving port. The toner cartridge includes a toner housing and a toner shutter. The toner housing is capable of accommodating the toner. The toner housing has a toner discharge port. The toner discharge port discharges the toner in the toner housing. The toner shutter opens and closes the toner discharge port.

In the image forming apparatus disclosed in the related-art, in order to prevent a change in a contact state of the developing roller with the photosensitive drum, the developing roller and the developing housing supporting the developing roller are considered to be movable with respect to the photosensitive drum.

However, when the developing housing moves, a position of the toner receiving port with respect to the toner shutter changes, and toner supplied from the toner cartridge to the developing housing may leak.

SUMMARY

An aspect of the present disclosure provides an image forming apparatus capable of preventing leakage of toner supplied from a toner cartridge to a developing housing in a configuration in which the toner is supplied from the toner cartridge to the developing housing movable with respect to a photosensitive drum.

According to an aspect of the present disclosure, there is provided an image forming apparatus including: a main body housing; a drum cartridge mountable in the main body housing, the drum cartridge including: a photosensitive drum rotatable about a drum axis extending in a first direction; a developing device capable of supplying toner to the photosensitive drum; and a drum frame supporting the photosensitive drum and the developing device; and a toner cartridge mountable in the main body housing, the toner cartridge being capable of supplying the toner to the developing device in a state where the drum cartridge and the toner cartridge are mounted in the main body housing, and the toner cartridge including: a toner housing capable of accommodating the toner, the toner housing having a toner discharge port for discharging the toner in the toner housing; and a toner shutter movable between a toner closed position where the toner shutter closes the toner discharge port and a toner open position where the toner discharge port is opened, wherein the developing device includes: a developing roller rotatable about a developing shaft extending in the first direction; and a developing housing supporting the developing roller and movable with respect to the photosensitive drum in a second direction intersecting with the first direction, the developing housing having a toner receiving port for receiving the toner discharged from the toner discharge port, wherein the drum cartridge further includes: a developing shutter movable between a developing closed position where the developing shutter closes the toner receiving port and a developing open position where the toner receiving port is opened, the developing shutter being engaged with the toner cartridge in a state where the drum cartridge and the toner cartridge are mounted in the main body housing, and the developing shutter being supported by the drum frame; and a cushion member located between the developing housing and the developing shutter, and wherein in a case where the developing housing moves with respect to the photosensitive drum in a state where: the drum cartridge and the toner cartridge are mounted in the main body housing; the developing shutter is located at the developing open position; and the toner shutter is located at the toner open position, the cushion member allows the developing housing to move with respect to the developing shutter in a state where the developing shutter is engaged with the toner cartridge.

DESCRIPTION OF EMBODIMENTS

1. Image Forming Apparatus 1

Figure 1:
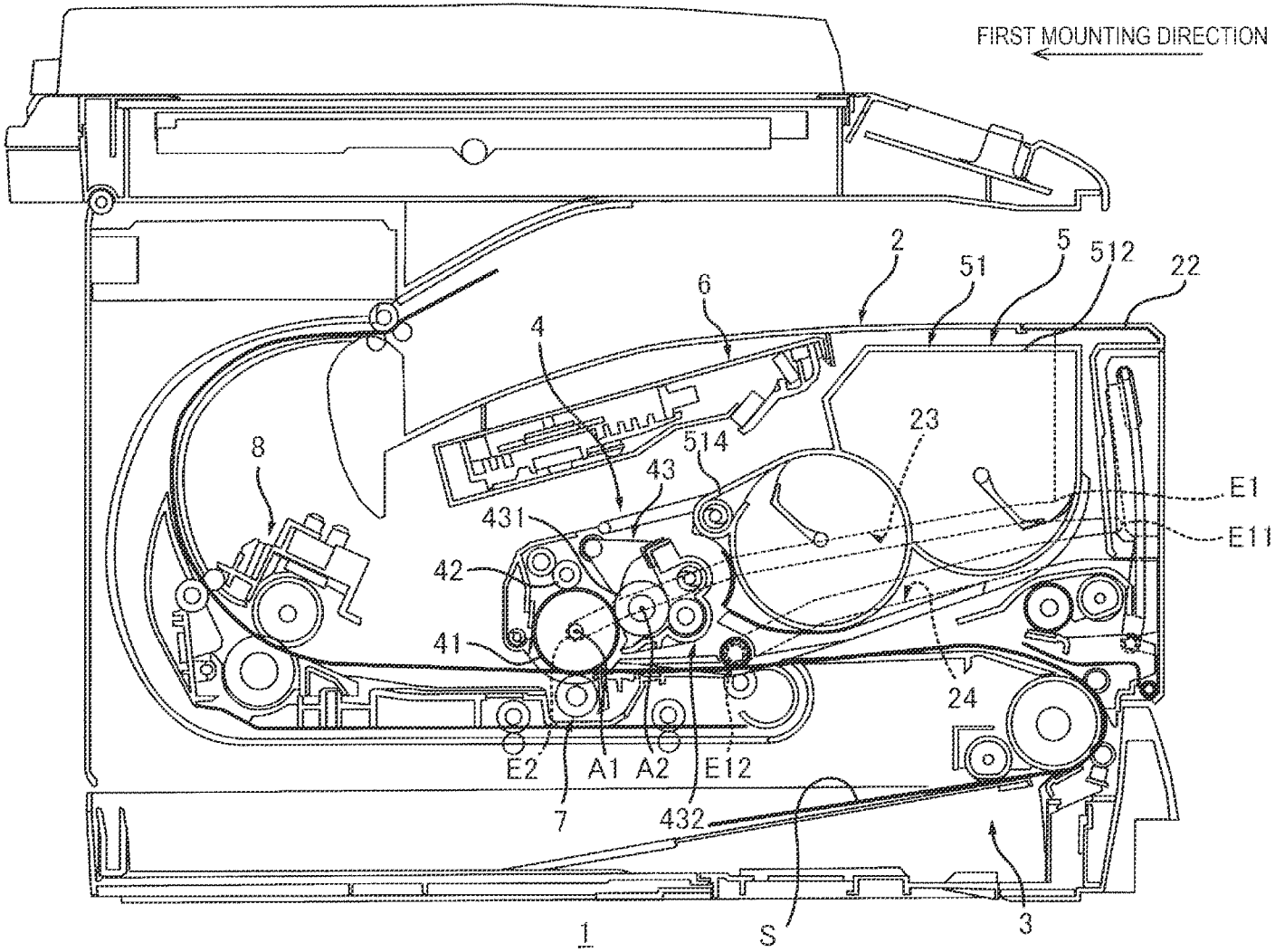
FIG. 1 is a schematic configuration view of an image forming apparatus according to a first embodiment.

An image forming apparatus 1 will be described with reference to FIGS. 1 and 2.

The image forming apparatus 1 includes a main body housing 2, a sheet cassette 3, a drum cartridge 4, a toner cartridge 5, an exposure device 6, a transfer device 7 and a fixing device 8.

1.1 Main Body Housing 2

The main body housing 2 accommodates the sheet cassette 3, the drum cartridge 4, the toner cartridge 5, the exposure device 6, the transfer device 7 and the fixing device 8.

Figure 2:
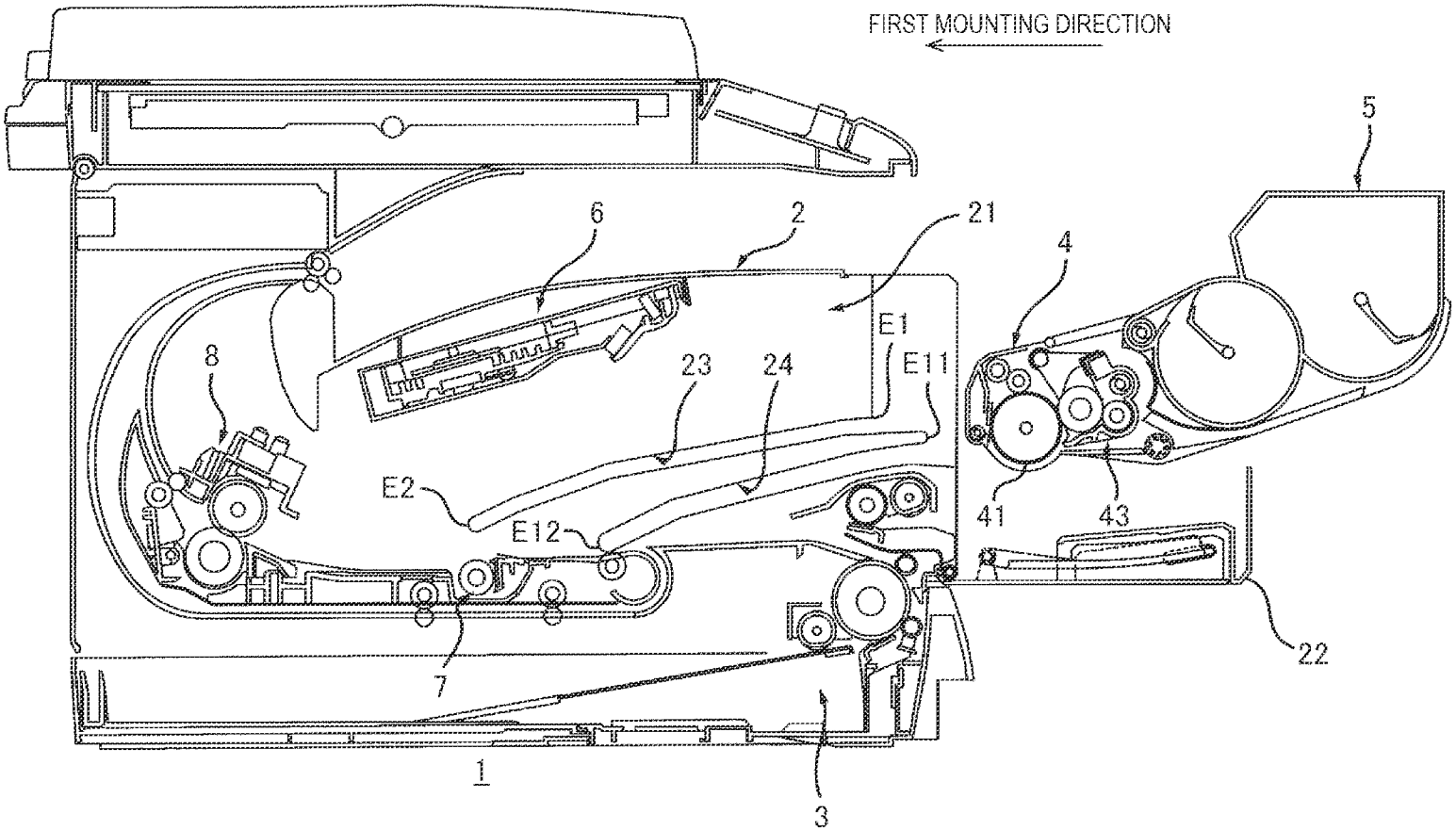
FIG. 2 shows a state where a drum cartridge is detached from a main body housing.

As shown in FIG. 2, the main body housing 2 has an opening 21. The main body housing 2 includes a cover 22, a guide 23 and a guide 24.

The opening 21 is located on one side wall of the main body housing 2 in a first mounting direction. The first mounting direction is a moving direction of the drum cartridge 4 when the drum cartridge 4 is mounted in the main body housing 2. Specifically, the first mounting direction is a direction in which the guide 23 extends.

The cover 22 is movable between a closed position (see FIG. 1) and an open position (see FIG. 2). In a state where the cover 22 is located at the closed position, the cover 22 closes the opening 21. In a state where the cover 22 is located at the open position, the opening 21 is opened.

Figure 6:
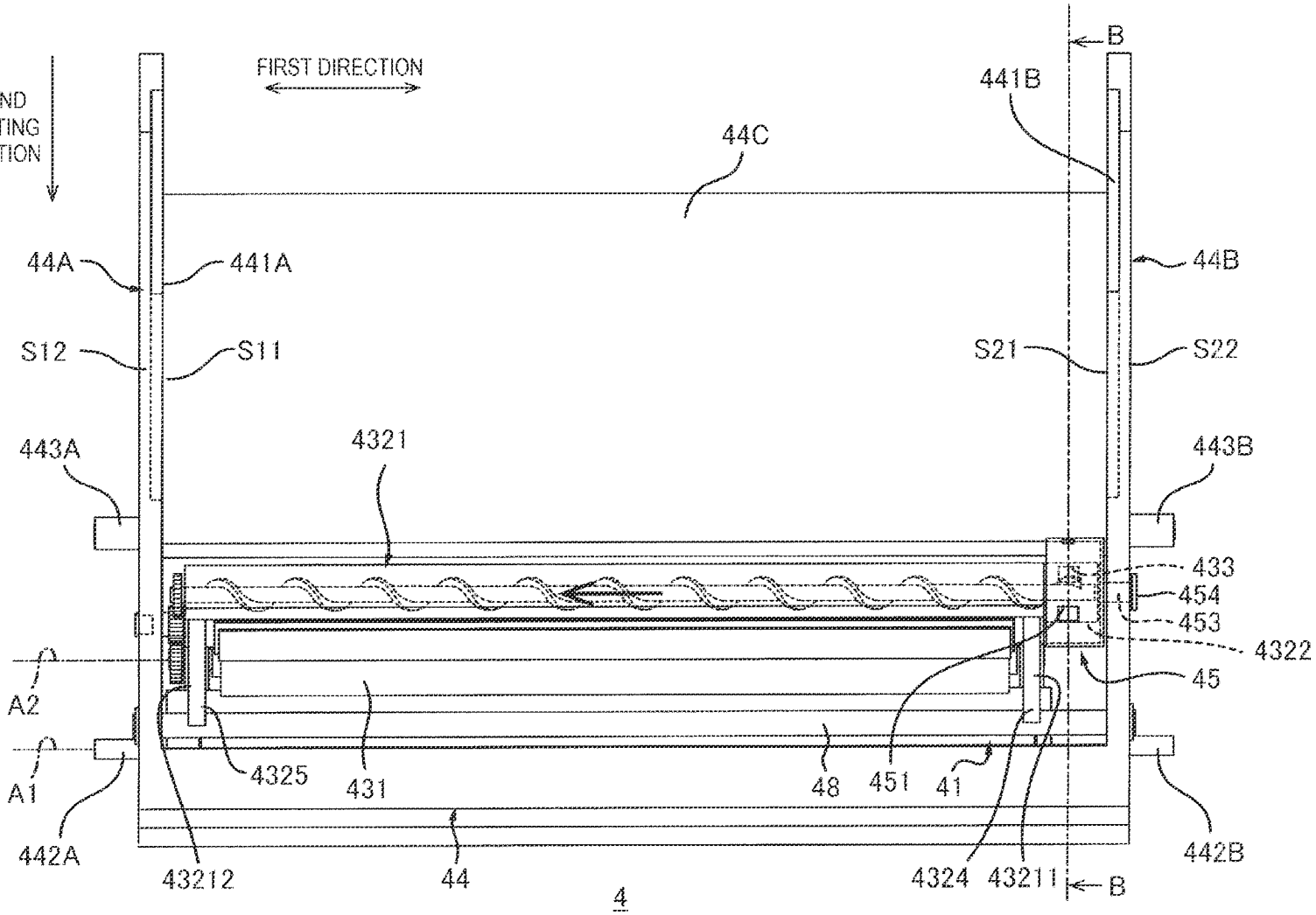
FIG. 6 is a plan view of the drum cartridge shown in FIG. 1.

The guide 23 guides a protrusion 442A of the drum cartridge 4 (see FIG. 6). The protrusion 442A will be described later. The guide 23 extends in the first mounting direction. The guide 23 has a first end portion E1 and a second end portion E2 in the first mounting direction. In the state where the cover 22 is located at the closed position, the first end portion E1 is located between the second end portion E2 and the cover 22 in the first mounting direction. The second end portion E2 is located away from the first end portion E1 in the first mounting direction. The guide 23 is a groove. The guide 23 may be a rib.

The guide 24 guides a protrusion 443A of the drum cartridge 4 (see FIG. 6). The protrusion 443A will be described later. The guide 24 extends in the first mounting direction side by side with the guide 23. The guide 24 has a first end portion E11 and a second end portion E12 in the first mounting direction. In the state where the cover 22 is located at the closed position, the first end portion E11 is located between the second end portion E12 and the cover 22 in the first mounting direction. The second end portion E12 is located away from the first end portion E11 in the first mounting direction. The guide 24 is a groove. The guide 24 may be a rib.

1.2 Sheet Cassette 3

As shown in FIG. 1, the sheet cassette 3 can accommodate a sheet S. The sheet S in the sheet cassette 3 is conveyed toward a photosensitive drum 41 of the drum cartridge 4. The photosensitive drum 41 will be described later.

1.3 Drum Cartridge 4

The drum cartridge 4 is mountable in the main body housing 2. Specifically, the drum cartridge 4 is mounted in the main body housing 2 through the opening 21 (see FIG. 2) in the state where the cover 22 is located at the open position. The drum cartridge 4 is positioned with respect to the main body housing 2 in the state where the drum cartridge 4 is mounted in the main body housing 2. Specifically, in the state where the drum cartridge 4 is mounted in the main body housing 2, the protrusion 442A (see FIG. 6) is fitted to the second end portion E2 of the guide 23, and the protrusion 443A (see FIG. 6) is fitted to the second end portion E12 of the guide 24. In this state, the drum cartridge 4 is positioned with respect to the main body housing 2. In the state where the toner cartridge 5 is mounted on the drum cartridge 4, the drum cartridge 4 is mountable in the main body housing 2. The drum cartridge 4 includes the photosensitive drum 41, a charging device 42 and a developing device 43.

1.3.1 Photosensitive Drum 41

The photosensitive drum 41 extends in a first direction. The first direction intersects with the first mounting direction. Preferably, the first direction is orthogonal to the first mounting direction. The photosensitive drum 41 is rotatable about a drum axis A1. The drum axis A1 extends in the first direction.

1.3.2 Charging Device 42

The charging device 42 charges a surface of the photosensitive drum 41. In the present embodiment, the charging device 42 is a charging roller. The charging device 42 is in contact with the surface of the photosensitive drum 41. The charging device 42 may be a scorotron-type charging device.

1.3.3 Developing Device 43

The developing device 43 is capable of supplying toner to the photosensitive drum 41. The developing device 43 includes a developing roller 431 and a developing housing 432.

The developing roller 431 extends in the first direction. The developing roller 431 is rotatable about a developing axis A2. The developing axis A2 extends in the first direction. The developing roller 431 is capable of supplying the toner in the developing housing 432 to the photosensitive drum 41. In the present embodiment, the developing roller 431 is in contact with the photosensitive drum 41. The developing roller 431 may be spaced apart from the photosensitive drum 41 at a predetermined distance.

The developing housing 432 accommodates the toner to be supplied to the photosensitive drum 41. The developing housing 432 supports the developing roller 431.

1.4 Toner Cartridge 5

The toner cartridge 5 is mountable in the main body housing 2. In the present embodiment, the toner cartridge 5 is mountable on the drum cartridge 4 in a state where the drum cartridge 4 is detached from the main body housing 2. The toner cartridge 5 is mounted in the main body housing 2 by mounting the drum cartridge 4 in the main body housing 2 in a state where the toner cartridge 5 is mounted on the drum cartridge 4. In the state where the toner cartridge 5 is mounted on the drum cartridge 4, the toner cartridge 5 is located on a side opposite to the photosensitive drum 41 with respect to the developing roller 431. The toner cartridge 5 includes a toner housing 51.

The toner housing 51 is capable of accommodating the toner to be supplied to the developing device 43. In the state where the drum cartridge 4 and the toner cartridge 5 are mounted in the main body housing 2, the toner cartridge 5 is capable of supplying the toner to the developing device 43.

1.5 Exposure Device 6

In the state where the drum cartridge 4 and the toner cartridge 5 are mounted in the main body housing 2, the exposure device 6 exposes the surface of the photosensitive drum 41 charged by the charging device 42. The developing device 43 supplies the toner to the exposed surface of the photosensitive drum 41. In the present embodiment, the exposure device 6 is a laser scanning unit. The exposure device 6 may be an LED head.

1.6 Transfer Device 7

The transfer device 7 transfers the toner on the photosensitive drum 41 to the sheet S. Specifically, the sheet S from the sheet cassette 3 passes between the transfer device 7 and the photosensitive drum 41. At this time, the transfer device 7 transfers the toner on the photosensitive drum 41 to the sheet S. In the present embodiment, the transfer device 7 is a transfer roller. In the state where the drum cartridge 4 is mounted in the main body housing 2, the transfer device 7 is in contact with the photosensitive drum 41. In the state where the drum cartridge 4 is mounted in the main body housing 2, the transfer device 7 may be spaced apart from the photosensitive drum 41 at a predetermined distance.

1.7 Fixing Device 8

The fixing device 8 fixes the toner to the sheet S. In the present embodiment, the fixing device 8 fixes the toner to the sheet S by heating and pressurizing the sheet S to which the toner is transferred. The sheet S that has passed through the fixing device 8 is discharged to an upper surface of the main body housing 2.

2. Details of Toner Cartridge 5

Next, the toner cartridge 5 will be described in detail with reference to FIGS. 3 to 5B. 11 and 12.

Figure 3:
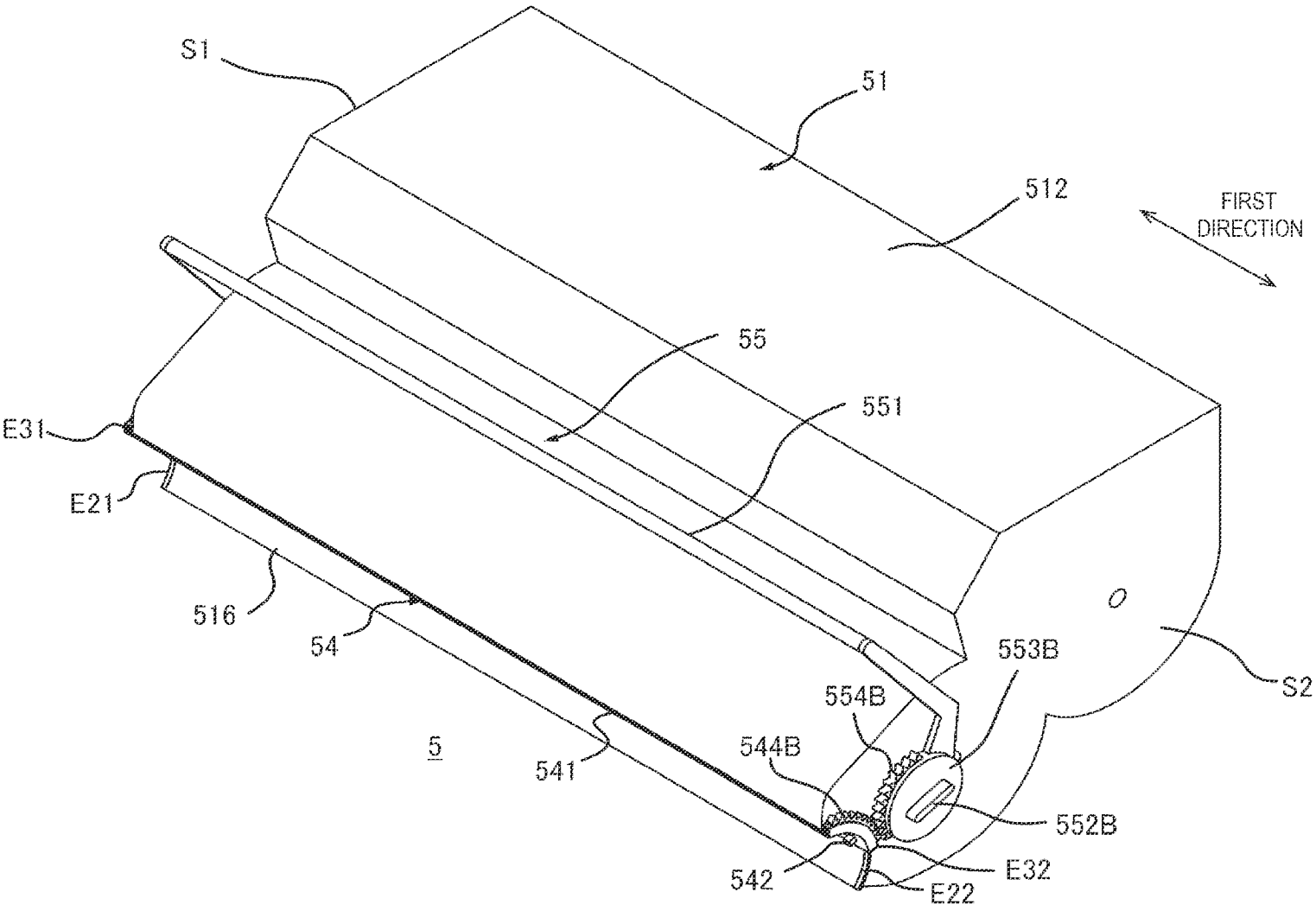
FIG. 3 is a perspective view of a toner cartridge shown in FIG. 1.
Figure 4:
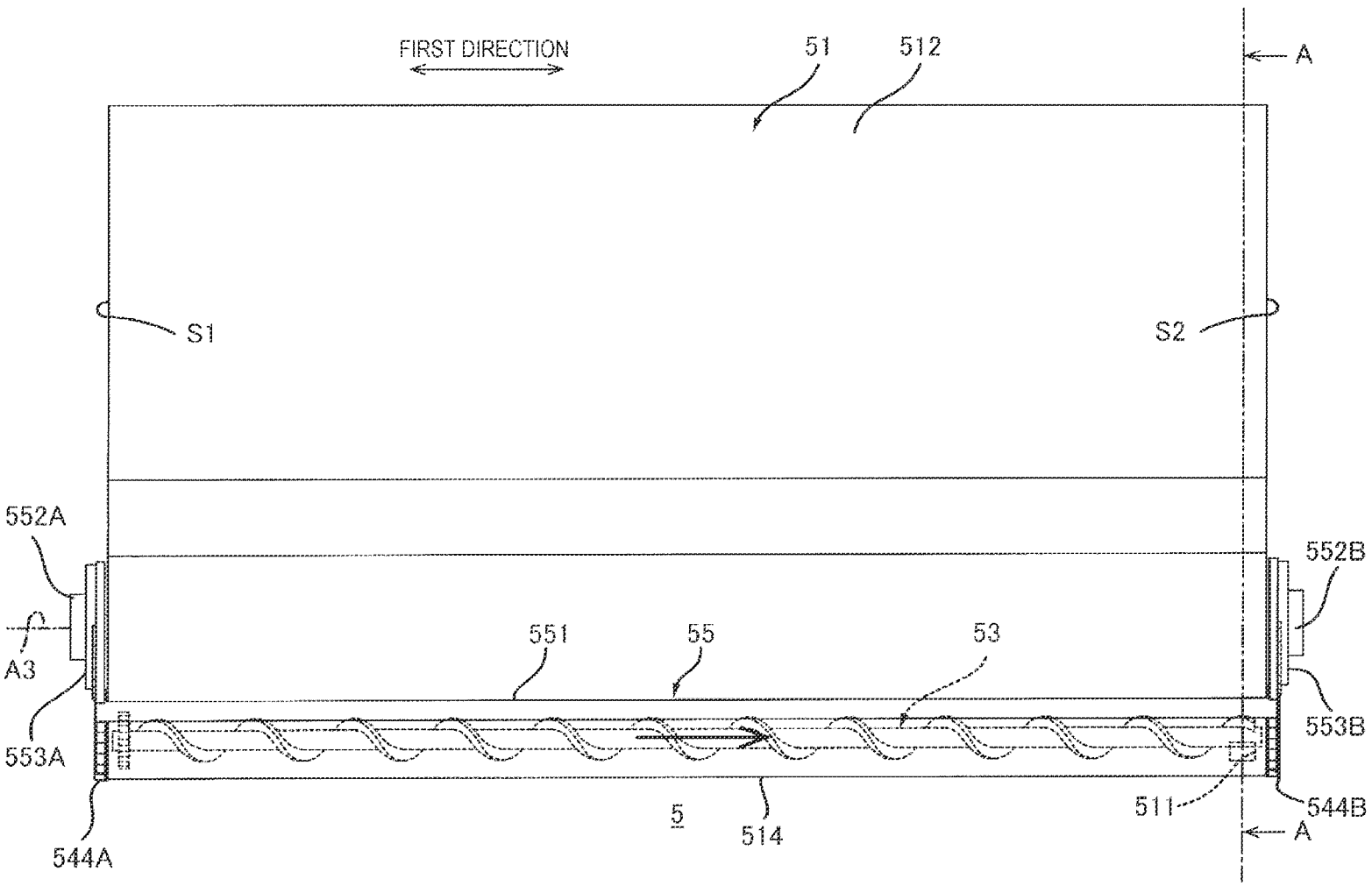
FIG. 4 is a plan view of the toner cartridge shown in FIG. 3.

As shown in FIGS. 3 and 4, the toner cartridge 5 includes the above-described toner housing 51, an auger screw 53 (see FIG. 4), a seal member 52 (see FIG. 12), a toner shutter 54 and a handle 55.

2.1 Details of Toner Housing 51

The toner housing 51 extends in the first direction. The toner housing 51 has one side surface S1 in the first direction and the other side surface S2 in the first direction.

Figure 5A:
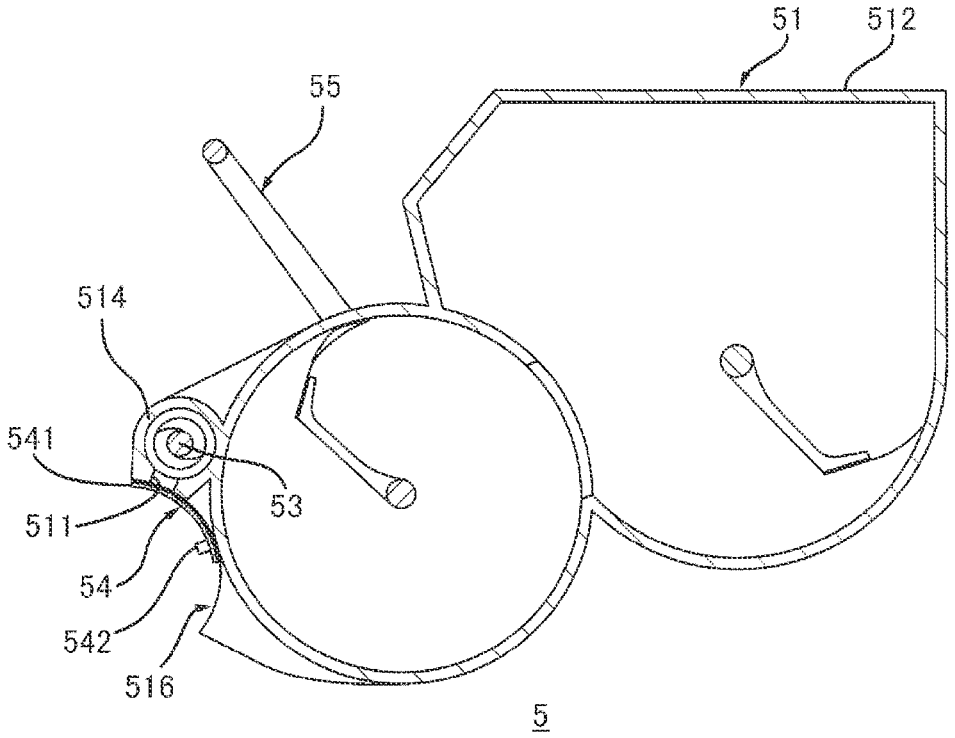
FIG. 5A is a cross-sectional view of the toner cartridge shown in FIG. 4 taken along a line A-A.

As shown in FIG. 5A, the toner housing 51 includes a toner accommodating portion 512, a receiving portion 516 and a toner conveying portion 514.

2.1.1 Toner Accommodating Portion 512

The toner accommodating portion 512 is capable of accommodating the toner.

2.1.2 Receiving Portion 516

Figure 11:
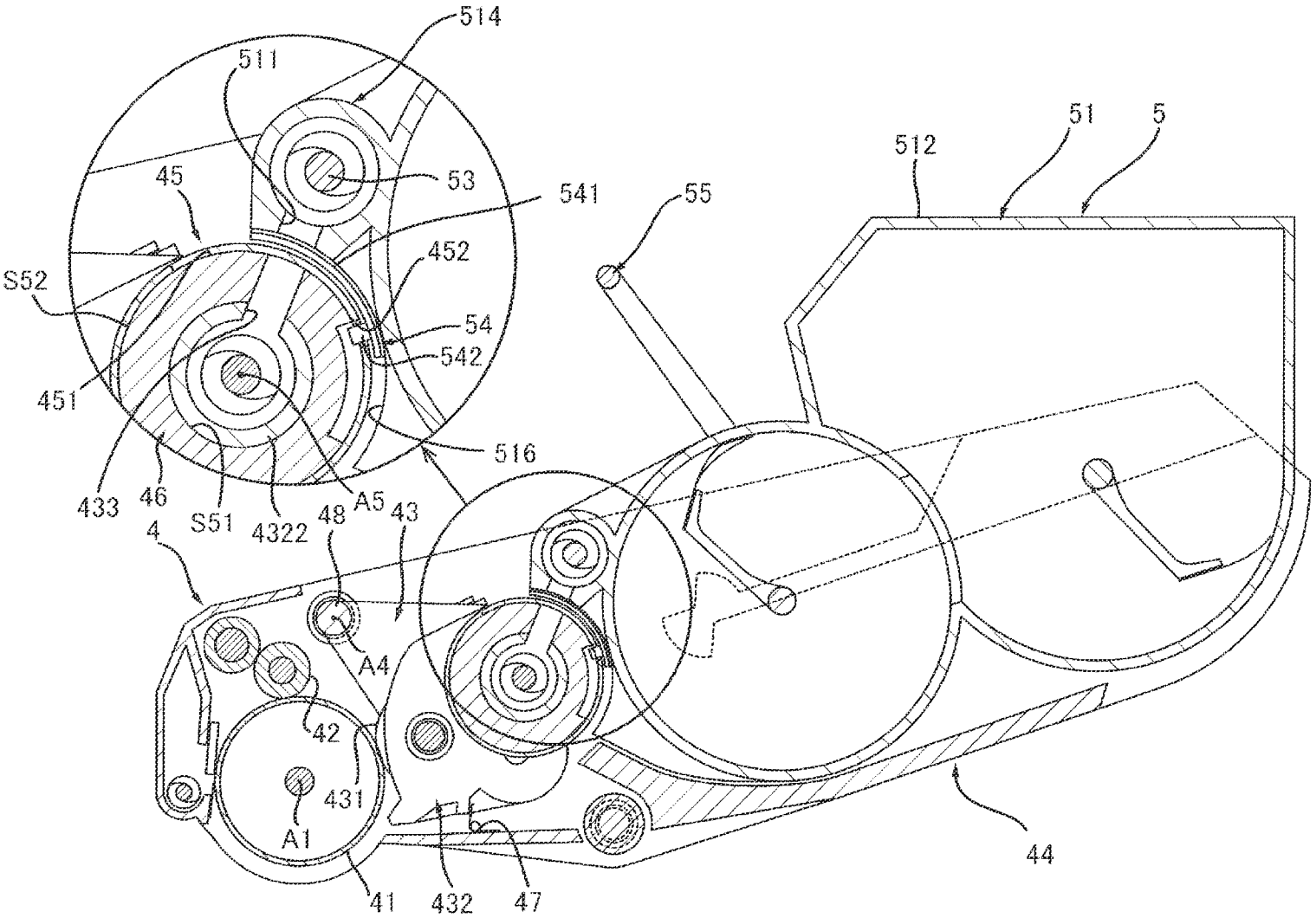
FIG. 11 shows a state where the toner cartridge is mounted on the drum cartridge, the developing shutter is located at the developing closed position, and a toner shutter is located at a toner closed position.

In the state where the toner cartridge 5 is mounted on the drum cartridge 4, the receiving portion 516 receives a developing shutter 45 via the toner shutter 54 (see FIG. 11). The receiving portion 516 extends along a circumferential surface of the developing shutter 45. The developing shutter 45 will be described later.

The receiving portion 516 is arranged next to the toner accommodating portion 512 in a direction intersecting with the first direction. The receiving portion 516 extends in a moving direction of the toner shutter 54.

As shown in FIG. 3, the receiving portion 516 extends in the first direction. The receiving portion 516 has one end portion E21 and the other end portion E22 in the first direction. One end portion E21 of the receiving portion 516 protrudes from the side surface S1 in the first direction. The other end portion E22 of the receiving portion 516 protrudes from the side surface S2 in the first direction.

As shown in FIG. 5A, the receiving portion 516 has a toner discharge port 511. In other words, the toner housing 51 has the toner discharge port 511. The toner discharge port 511 discharges the toner in the toner housing 51.

2.1.3 Toner Conveying Portion 514

The toner from the toner accommodating portion 512 toward the toner discharge port 511 passes through the toner conveying portion 514. The toner conveying portion 514 is located between the receiving portion 516 and the toner accommodating portion 512. The toner conveying portion 514 is connected to the toner accommodating portion 512 and the receiving portion 516. The toner conveying portion 514 extends in the first direction. The toner conveying portion 514 has a cylindrical shape. An internal space of the toner conveying portion 514 communicates with an internal space of the toner accommodating portion 512 (see FIG. 1). The internal space of the toner conveying portion 514 communicates with the toner discharge port 511.

2.2 Auger Screw 53

The auger screw 53 conveys the toner in the toner conveying portion 514 toward the toner discharge port 511. The auger screw 53 is located in the toner conveying portion 514. The auger screw 53 extends in the first direction. The auger screw 53 is rotatable about an axis. The axis of the auger screw 53 extends in the first direction.

2.3 Seal Member 52

Figure 12:
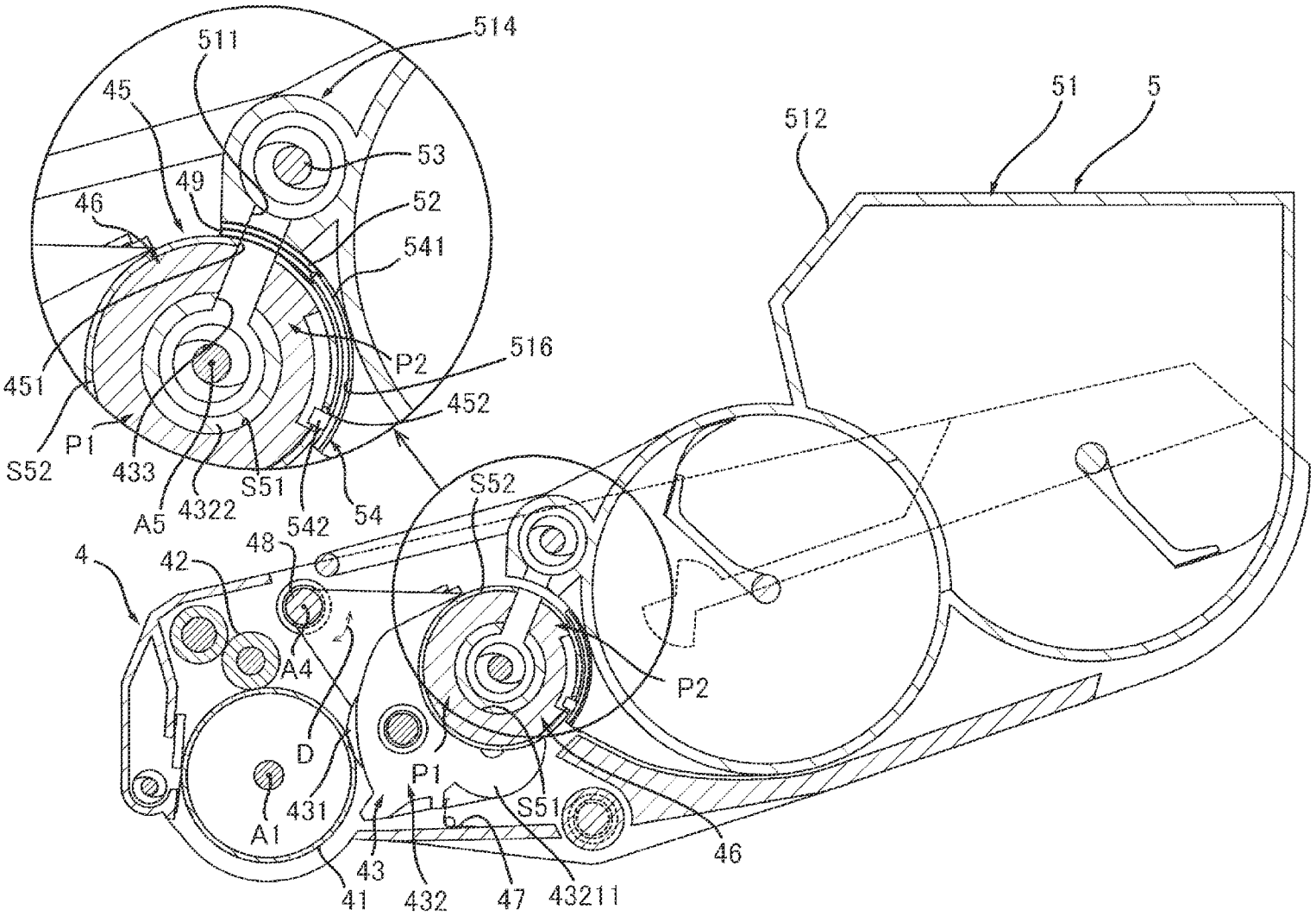
FIG. 12 shows a state where the toner cartridge is mounted on the drum cartridge, the developing shutter is located at the developing open position, and the toner shutter is located at a toner open position.

As shown in FIG. 12, in a state where the toner shutter 54 is located at a toner closed position, the seal member 52 seals between the receiving portion 516 and the toner shutter 54. In a state where the toner shutter 54 is located at a toner open position, the seal member 52 expands so as to fill a space where the toner shutter 54 has moved. The seal member 52 is located on a side opposite to the toner conveying portion 514 with respect to the receiving portion 516. The seal member 52 may be attached to the receiving portion 516 with an adhesive or the like. The seal member 52 surrounds the toner discharge port 511. In FIGS. 5A and 11, the seal member 52 is omitted for convenience.

2.4 Toner Shutter 54

As shown in FIGS. 11 and 12, the toner shutter 54 is movable along the receiving portion 516 between the toner closed position (see FIG. 11) and the toner open position (see FIG. 12). As shown in FIG. 11, in the state where the toner shutter 54 is located at the toner closed position, the toner shutter 54 closes the toner discharge port 511. As shown in FIG. 12, in the state where the toner shutter 54 is located at the toner open position, the toner discharge port 511 is opened.

As shown in FIG. 3, the toner shutter 54 includes a toner shutter main body 541 and a protrusion 542.

2.4.1 Toner Shutter Main Body 541

The toner shutter main body 541 extends along the receiving portion 516. The toner shutter main body 541 extends in the moving direction of the toner shutter 54. The toner shutter main body 541 is an arc-shaped plate. The toner shutter main body 541 extends in the first direction. The toner shutter main body 541 has one end portion E31 and the other end portion E32 in the first direction. When the toner shutter 54 moves between the toner closed position (see FIG. 11) and the toner open position (see FIG. 12), one end portion E31 of the toner shutter main body 541 is guided by one end portion E21 of the receiving portion 516 and the other end portion E32 of the toner shutter main body 541 is guided by the other end portion E22 of the receiving portion 516.

The one end portion E31 of the toner shutter main body 541 has a U shape. The one end portion E21 of the receiving portion 516 is fitted to the one end portion E31 of the toner shutter main body 541. A shutter gear 544A is provided at the one end portion E31 of the toner shutter main body 541 (see FIG. 4). The shutter gear 544A includes a plurality of gear teeth.

The other end portion E32 of the toner shutter main body 541 has a U shape. The other end portion E32 of the receiving portion 516 is fitted to the other end portion E32 of the toner shutter main body 541. A shutter gear 544B is provided at the other end portion E32 of the toner shutter main body 541. The shutter gear 544B includes a plurality of gear teeth.

2.4.2 Protrusion 542

The protrusion 542 is located on a side opposite to the receiving portion 516 with respect to the toner shutter main body 541. The protrusion 542 is located between the one end portion E31 and the other end portion E32 of the toner shutter main body 541 in the first direction. The protrusion 542 protrudes from the toner shutter main body 541 in a radial direction of the toner shutter main body 541. The protrusion 542 may be attached to the toner shutter main body 541.

2.5 Handle 55

As shown in FIG. 4, the handle 55 is operated by a user to move the toner shutter 54. The handle 55 includes a plate 553A, a protrusion 552A, a plate 553B, a protrusion 552B and a handle main body 551.

2.5.1 Plate 553A

Figure 9:
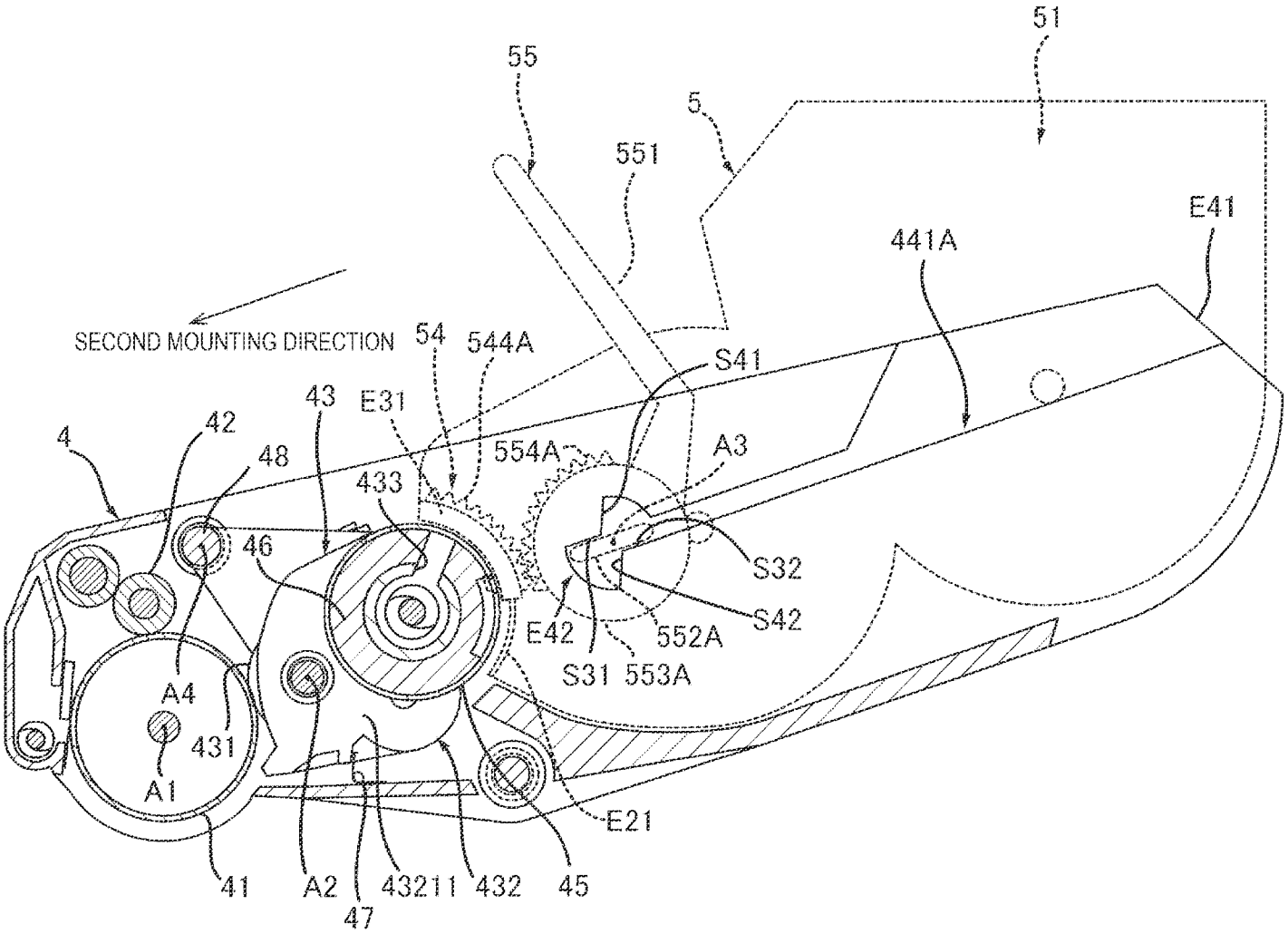
FIG. 9 shows a state where the toner cartridge is mounted on the drum cartridge and the toner cartridge is detachable from the drum cartridge.

The plate 553A is disposed on the side surface S1. The plate 553A is supported by the toner housing 51. As shown in FIG. 9, the plate 553A has a circular shape. The plate 553A faces one end portion E31 of the toner shutter main body 541 in a radial direction of the plate 553A. The plate 553A is rotatable about an axis A3. The axis A3 extends in the first direction. A handle gear 554A is provided on a part of a circumferential surface of the plate 553A. The handle gear 554A has a plurality of gear teeth. The handle gear 554A meshes with the shutter gear 544A.

2.5.2 Protrusion 552A

The protrusion 552A is provided on the plate 553A. The protrusion 552A is located on a side opposite to the side surface S1 with respect to the plate 553A in the first direction (see FIG. 4). The protrusion 552A protrudes from the plate 553A in the first direction (see FIG. 4). The protrusion 552A may be attached to the plate 553A.

The protrusion 552A extends in the radial direction of the plate 553A. In the state where the toner cartridge 5 is mounted on the drum cartridge 4, the protrusion 552A is fitted to a guide 441A of the drum cartridge 4. The guide 441A will be described later.

In the state where the toner cartridge 5 is mounted on the drum cartridge 4 and the toner shutter 54 is located at the toner closed position, the protrusion 552A extends in a second mounting direction. The second mounting direction is a moving direction of the toner cartridge 5 when the toner cartridge 5 is mounted on the drum cartridge 4. The second mounting direction intersects with the first direction. Preferably, the second mounting direction is orthogonal to the first direction. In a state where the toner cartridge 5 is mounted on the drum cartridge 4 and the toner shutter 54 is located at the toner open position, the protrusion 552A extends in a direction intersecting with the first direction and the second mounting direction (see FIG. 10).

2.5.3 Plate 553B

Figure 5B:
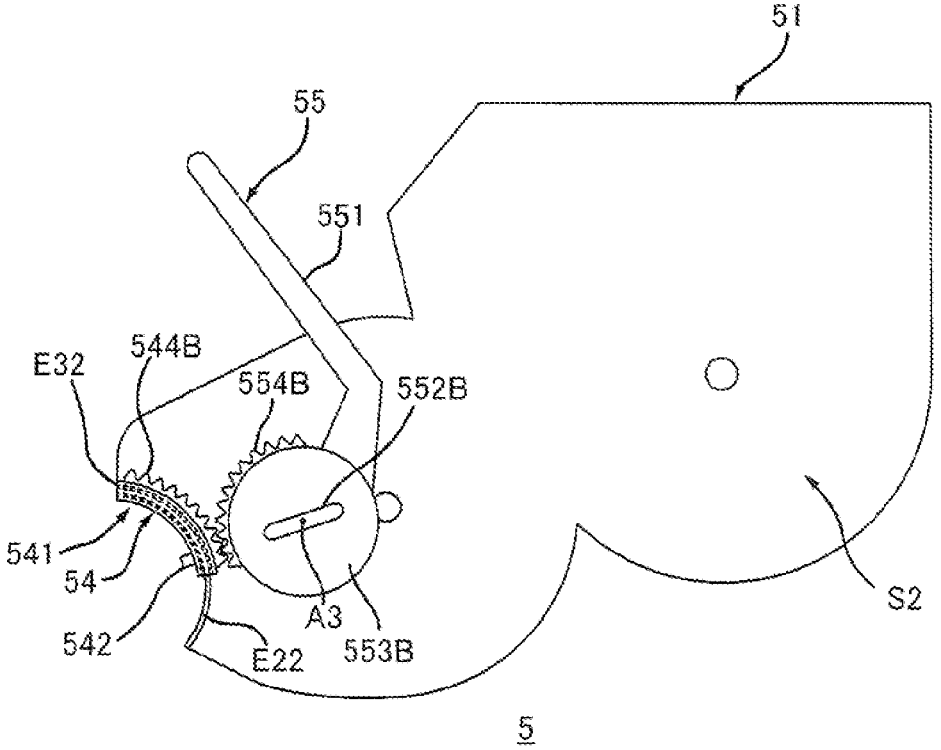
FIG. 5B is a side view of the toner cartridge shown in FIG. 4.

As shown in FIG. 5B, the plate 553B is disposed on the side surface S2. The plate 553B is described in the same manner as the plate 553A. The plate 553B faces the other end portion E32 of the toner shutter main body 541 in a radial direction of the plate 553B. A handle gear 554B is provided on a part of a circumferential surface of the plate 553B. The handle gear 554B has a plurality of gear teeth. The handle gear 554B meshes with the shutter gear 544B.

2.5.4 Protrusion 552B

The protrusion 552B is provided on the plate 553B. The protrusion 552B is located on a side opposite to the side surface S2 with respect to the plate 553B in the first direction. The protrusion 552B protrudes from the plate 553B in the first direction. The protrusion 552B may be attached to the plate 553B. The protrusion 552B has a shape the same as that of the protrusion 552A. When the toner cartridge 5 is mounted on the drum cartridge 4, the protrusion 552B is fitted to a guide 441B of the drum cartridge 4 (see FIG. 6). The guide 441B will be described later.

2.5.5 Handle Main Body 551

As shown in FIG. 3, the handle main body 551 has a U shape. The handle main body 551 has a first end and a second end. The first end of the handle main body 551 is connected to the plate 553A (see FIG. 9). The second end of the handle main body 551 is connected to the plate 553B.

When the user operates the handle main body 551, the plate 553A rotates and the plate 553B rotates. At this time, the handle gears 554A, 554B and the shutter gears 544A, 544B transmit a driving force to the toner shutter main body 541. Thereby, the toner shutter 54 moves between the toner closed position (see FIG. 11) and the toner open position (see FIG. 12). Therefore, the user can easily move the toner shutter 54 by operating the handle 55.

3. Details of Drum Cartridge 4

The drum cartridge 4 will be described in detail with reference to FIGS. 6 to 12.

Figure 7:
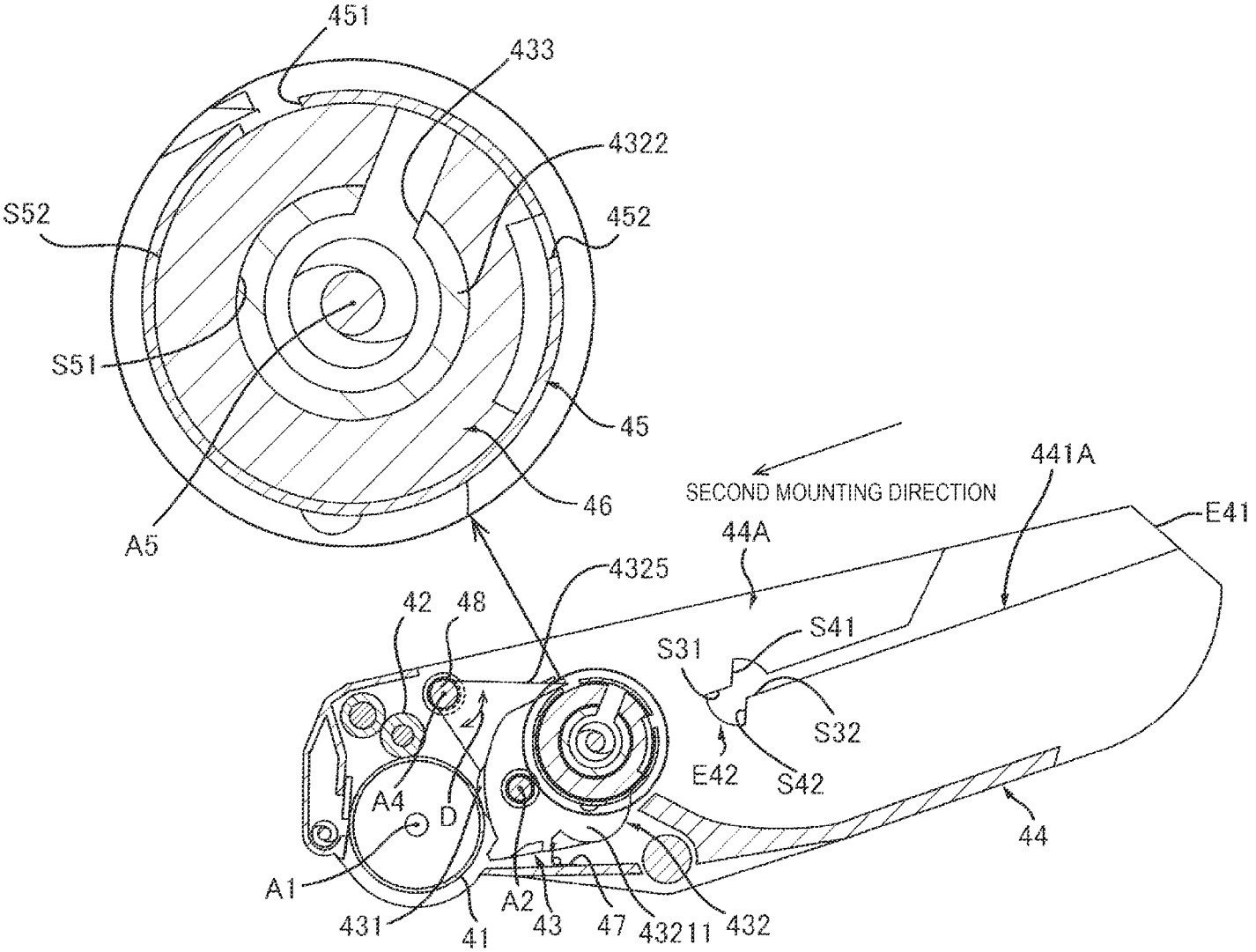
FIG. 7 is a cross-sectional view of the drum cartridge shown in FIG. 6 taken along a line B-B, which shows a state where a developing shutter is located at a developing closed position.

As shown in FIG. 6, the drum cartridge 4 includes the above-described photosensitive drum 41, the above-described charging device 42 (see FIG. 7), the above-described developing device 43, a drum frame 44, a shaft 48, a pressing member 47 (see FIG. 7), the developing shutter 45, a seal member 49 (see FIG. 12) and a cushion member 46 (see FIG. 7).

3.1 Drum Frame 44

The drum frame 44 supports the photosensitive drum 41, the developing device 43, the shaft 48, the pressing member 47 and the developing shutter 45.

The drum frame 44 has one side plate 44A in the first direction, the other side plate 44B in the first direction, a bottom plate 44C, two protrusions 442A, 442B and two protrusions 443A, 442B.

3.1.1 Side Plate 44A

The side plate 44A is located at one end portion of the drum frame 44 in the first direction. The side plate 44A extends in the second mounting direction. The side plate 44A has an inner surface S11 and an outer surface S12 in the first direction. The inner surface S11 is located between the outer surface S12 and the side plate 44B in the first direction. The side plate 44A includes the guide 441A.

As shown in FIG. 7, the guide 441A is located on a side opposite to the photosensitive drum 41 with respect to the developing device 43. The guide 441A extends in the second mounting direction. The guide 441A guides the protrusion 552A (see FIG. 4). The guide 441A is a groove. The guide 441A may be a rib.

The guide 441A has a first end portion E41 and a second end portion E42 in the second mounting direction. The first end portion E41 is located on a side opposite to the developing device 43 with respect to the second end portion E42 in the second mounting direction. The second end portion E42 is located away from the first end portion E41 in the second mounting direction.

As shown in FIG. 9, in the state where the toner cartridge 5 is mounted on the drum cartridge 4, the protrusion 552A is located at the second end portion E42 of the guide 441A. In the state where the toner cartridge 5 is mounted on the drum cartridge 4, the protrusion 552A is fitted to the second end portion E42 of the guide 441A, whereby the toner housing 51 of the toner cartridge 5 is positioned with respect to the drum cartridge 4. In the state where the toner cartridge 5 is mounted on the drum cartridge 4, the second end portion E42 allows the protrusion 552A to rotate about the axis A3 (see FIG. 10). The second end portion E42 includes a first guide surface S31, a second guide surface S32, a first lock surface S41 and a second lock surface S42.

The first guide surface S31 and the second guide surface S32 extend in the second mounting direction. In the state where the toner cartridge 5 is mounted on the drum cartridge 4, the first guide surface S31 is located on a side opposite to the second guide surface S32 with respect to the axis A3. In the state where the toner cartridge 5 is mounted on the drum cartridge 4 and the toner shutter 54 is located at the toner closed position, the protrusion 552A extending in the second mounting direction is located between the first guide surface S31 and the second guide surface S32 and faces the first guide surface S31 and the second guide surface S32 in a direction intersecting with the second mounting direction.

Therefore, in the state where the toner cartridge 5 is mounted on the drum cartridge 4 and the toner shutter 54 is located at the toner closed position, the toner cartridge 5 is detachable from the drum cartridge 4 along the guide 441A.

The first lock surface S41 and the second lock surface S42 extend in a direction intersecting with the second mounting direction. In the state where the toner cartridge 5 is mounted on the drum cartridge 4, the first lock surface S41 is located on a side opposite to the second lock surface S42 with respect to the axis A3. The first lock surface S41 is continuous with the first guide surface S31. The second lock surface S42 is continuous with the second guide surface S32.

Figure 10:
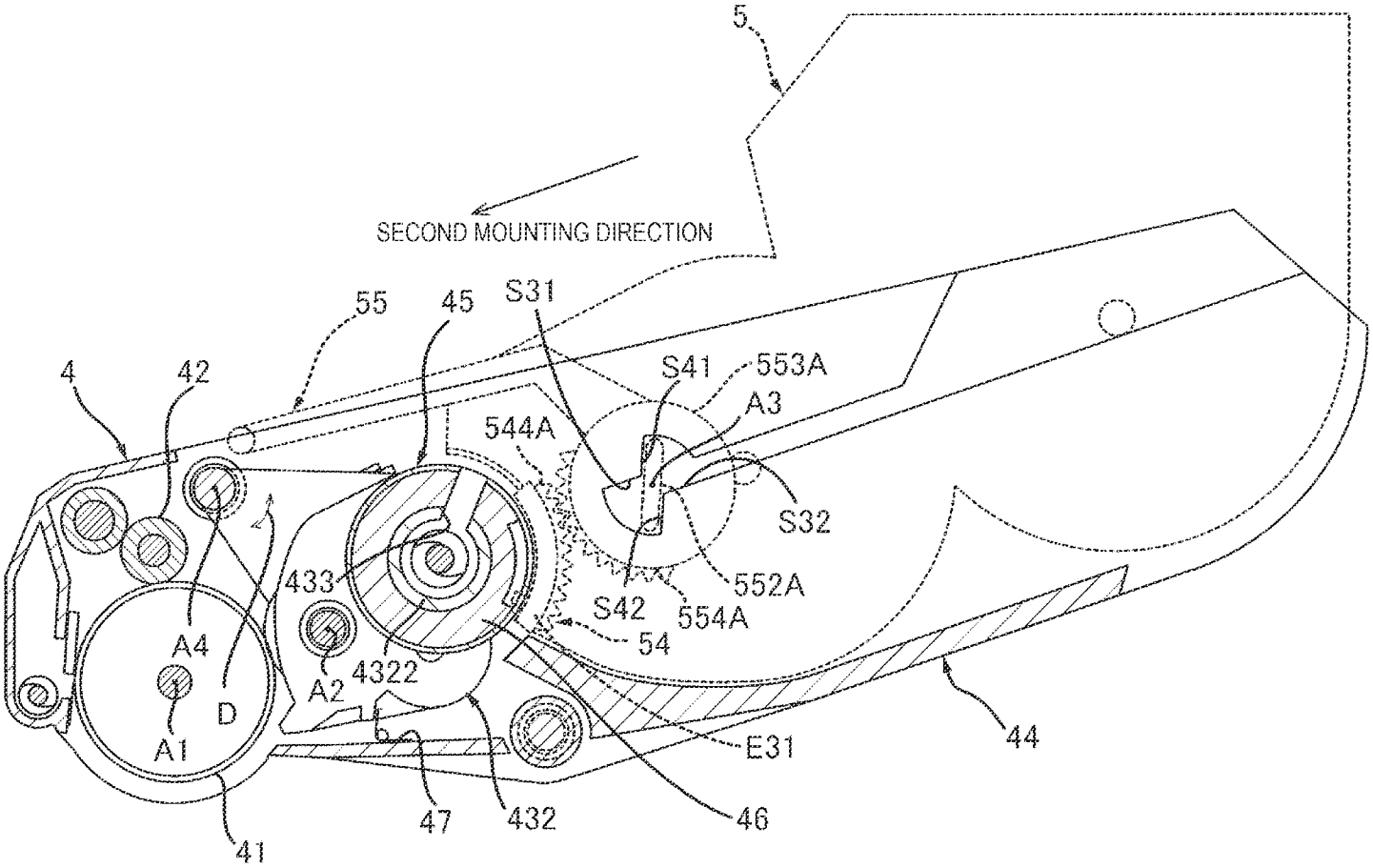
FIG. 10 shows a state where the toner cartridge is mounted on the drum cartridge and the toner cartridge is locked to the drum cartridge.

As shown in FIG. 10, in the state where the toner cartridge 5 is mounted on the drum cartridge 4 and the toner shutter 54 is located at the toner open position, the protrusion 552A extending in the direction intersecting with the second mounting direction is located between the first lock surface S41 and the second lock surface S42 and faces the first lock surface S41 and the second lock surface S42 in the second mounting direction.

Thereby, the toner cartridge 5 is locked to the drum cartridge 4 in a state where the toner cartridge 5 is mounted on the drum cartridge 4, the developing shutter 45 is located at a developing open position, and the toner shutter 54 is located at the toner open position. The developing shutter 45 will be described later.

"The toner cartridge 5 is locked to the drum cartridge 4" means that the toner cartridge 5 is fixed to the drum frame 44 in the second mounting direction. In the state where the toner cartridge 5 is locked to the drum cartridge 4, the toner cartridge 5 cannot move in the second mounting direction with respect to the drum cartridge 4.

Therefore, detachment of the toner cartridge 5 from the drum cartridge 4 can be prevented in the state where the developing shutter 45 is located at the developing open position and the toner shutter 54 is located at the toner open position.

3.1.2 Side Plate 44B

As shown in FIG. 6, the side plate 44B is located at the other end portion of the drum frame 44 in the first direction. The side plate 44B is spaced apart from the side plate 44A in the first direction. The side plate 44B extends in the second mounting direction. The side plate 44B has an inner surface S21 and an outer surface S22 in the first direction. The inner surface S21 is located between the outer surface S22 and the side plate 44A in the first direction. The side plate 44B includes the guide 441B.

The guide 441B has a shape the same as that of the guide 441A. The guide 441B guides the protrusion 552B of the toner cartridge 5 (see FIG. 4).

3.1.3 Bottom Plate 44C

The bottom plate 44C is located between the side plate 44A and the side plate 44B in the first direction. The bottom plate 44C extends in the first direction. One end portion of the bottom plate 44C in the first direction is connected to the side plate 44A. The other end portion of the bottom plate 44C in the first direction is connected to the side plate 44B.

3.1.4 Protrusions 442A, 442B, 443A, 443B

The protrusion 442A is located on the outer surface S12 of the side plate 44A. The protrusion 442A extends in the first direction. The protrusion 442A has a cylindrical shape. In the present embodiment, the protrusion 442A is one end portion of a shaft supporting the photosensitive drum 41. The protrusion 442A extends along the drum axis A1.

The protrusion 442B is located on the outer surface S22 of the side plate 44B. The protrusion 442B extends in the first direction. The protrusion 442B has a cylindrical shape. In the present embodiment, the protrusion 442B is the other end portion of the shaft supporting the photosensitive drum 41. The protrusion 442B extends along the drum axis A1.

The protrusion 443A is located on the outer surface S12 of the side plate 44A. The protrusion 443A is spaced apart from the protrusion 442A in a second direction D. The second direction D will be described later. The protrusion 443A extends in the first direction. The protrusion 443A has a cylindrical shape.

The protrusion 443B is located on the outer surface S22 of the side plate 44B. The protrusion 443B is spaced apart from the protrusion 442B in the second direction D. The protrusion 443B extends in the first direction. The protrusion 443B has a cylindrical shape.

3.2 Shaft 48

The shaft 48 is supported by the side plate 44A and the side plate 44B. The shaft 48 extends in the first direction. The shaft 48 has a cylindrical shape. As shown in FIG. 7, the shaft 48 is rotatable about an axis A4. The axis A4 extends in the first direction. The shaft 48 is located on a side opposite to the first end portion E41 with respect to the second end portion E42 of the guide 441A in the second mounting direction.

3.3 Pressing Member 47

The pressing member 47 presses the developing device 43 toward the photosensitive drum 41. In the present embodiment, the pressing member 47 is a torsion spring. The pressing member 47 may be a compression coil spring.

3.4 Details of Developing Device 43

As shown in FIG. 6, the developing device 43 includes the above-described developing roller 431 and the above-described developing housing 432.

3.4.1 Details of Developing Housing 432

The developing housing 432 is located between the side plate 44A and the side plate 44B in the first direction. The developing housing 432 extends in the first direction.

The developing housing 432 includes an accommodating portion 4321, a tubular portion 4322 (see FIG. 7), and two connecting portions 4324, 4325.

3.4.1.1 Accommodating Portion 4321

The accommodating portion 4321 accommodates the developing roller 431. The accommodating portion 4321 includes one side wall 43211 of the developing housing 432 in the first direction and the other side wall 43212 of the developing housing 432 in the first direction. The side wall 43211 is spaced apart from the side wall 43212 in the first direction. The side wall 43211 and the side wall 43212 rotatably support the developing roller 431.

3.4.1.2 Tubular Portion 4322

The tubular portion 4322 is located at one end portion of the developing housing 432 in the first direction. The tubular portion 4322 is located on a side opposite to the side wall 43212 with respect to the side wall 43211 in the first direction. The tubular portion 4322 is located between the side wall 43211 and the side plate 44B in the first direction. The tubular portion 4322 extends in the first direction. The tubular portion 4322 has a cylindrical shape.

As shown in FIG. 7, the tubular portion 4322 has a toner receiving port 433. In other words, the developing housing 432 has the toner receiving port 433. In the state where the drum cartridge 4 and the toner cartridge 5 are mounted in the main body housing 2, the toner receiving port 433 is capable of receiving the toner discharged from the toner discharge port 511 (see FIG. 12).

3.4.1.3 Two Connecting Portions 4324, 4325

The connecting portion 4324 connects the side wall 43211 to the shaft 48. The connecting portion 4325 is spaced apart from the connecting portion 4324 in the first direction. The connecting portion 4325 connects the side wall 43212 to the shaft 48. Thereby, as shown in FIG. 7, the developing housing 432 is rotatable about the axis A4 of the shaft 48. In other words, the developing housing 432 is movable with respect to the photosensitive drum 41 in the second direction D that is a rotation direction. The second direction D intersects with the first direction.

3.5 Developing Shutter 45

Figure 8:
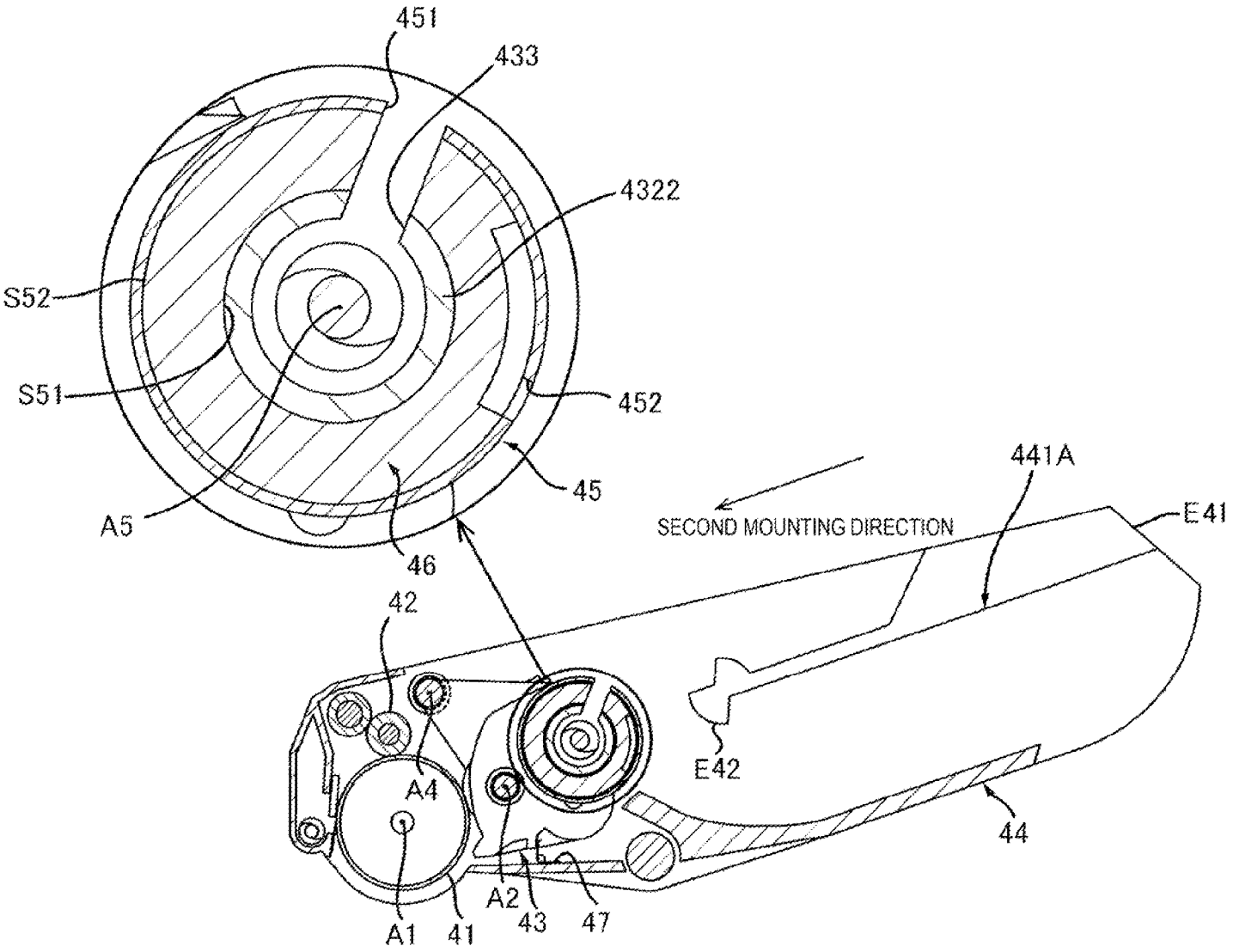
FIG. 8 is a cross-sectional view of the drum cartridge shown in FIG. 6 taken along the line B-B, which shows a state where the developing shutter is located at a developing open position.

The developing shutter 45 is movable between a developing closed position (see FIG. 7) and the developing open position (see FIG. 8). The developing shutter 45 is rotatable about an axis A5 between the developing closed position and the developing open position. The axis A5 extends in the first direction. As shown in FIG. 7, in the state where the developing shutter 45 is located at the developing closed position, the developing shutter 45 closes the toner receiving port 433. As shown in FIG. 8, in the state where the developing shutter 45 is located at the developing open position, the toner receiving port 433 is opened.

As shown in FIG. 6, the developing shutter 45 extends in the first direction. The developing shutter 45 has a cylindrical shape. Therefore, the developing shutter 45 can move between the developing closed position and the developing open position by being rotated. Therefore, a space where the developing shutter 45 moves can be reduced.

The developing shutter 45 is located on the side opposite to the side wall 43212 with respect to the side wall 43211 in the first direction. The developing shutter 45 is supported by the side plate 44B of the drum frame 44. The side plate 44B of the drum frame 44 supports one end portion of the developing shutter 45 in the first direction.

Specifically, an end portion of a cylinder of the developing shutter 45 in the first direction is closed, and a shaft portion 453 protruding from the end portion in the first direction is provided, and the side plate 44B of the drum frame 44 holds the shaft portion 453. The shaft portion 453 is provided with a flange portion 454 on a side opposite to the tubular portion 4322 with respect to the side plate 44B so that the developing shutter 45 does not come off from the side plate 44B.

As shown in FIG. 7, the developing shutter 45 is located on an outer side of the tubular portion 4322. In other words, the tubular portion 4322 is located in an inner side of the developing shutter 45. The tubular portion 4322 is spaced apart from the developing shutter 45 in a radial direction of the developing shutter 45. The developing shutter 45 has a developing shutter opening 451 and a hole 452.

3.5.1 Developing Shutter Opening 451

In the state where the developing shutter 45 is located at the developing closed position, the developing shutter opening 451 is spaced apart from the toner receiving port 433. In the state where the developing shutter 45 is located at the developing closed position, the entire developing shutter opening 451 does not communicate with the toner receiving port 433.

As shown in FIG. 8, in the state where the developing shutter 45 is located at the developing open position, at least a part of the developing shutter opening 451 communicates with the toner receiving port 433.

As shown in FIG. 12, in the state where the toner cartridge 5 is mounted on the drum cartridge 4, the developing shutter 45 is fitted to the receiving portion 516 of the toner cartridge 5. In the state where the drum cartridge 4 and the toner cartridge 5 are mounted in the main body housing 2, the developing shutter 45 is located at the developing open position, and the toner shutter 54 is located at the toner open position, the toner discharge port 511 communicates with the developing shutter opening 451. Accordingly, the toner discharged from the toner discharge port 511 enters the tubular portion 4322 of the developing housing 432 through the developing shutter opening 451 and the toner receiving port 433.

In the state where the drum cartridge 4 and the toner cartridge 5 are mounted in the main body housing 2, the toner discharge port 511 is located above the toner receiving port 433. Therefore, the toner in the toner cartridge 5 can be supplied to the developing device 43 using gravity. Then, the toner discharged from the toner discharge port 511 enters the developing housing 432 through the toner shutter opening 543 and the toner receiving port 433.

3.5.2 Hole 452

The hole 452 is spaced apart from the developing shutter opening 451 in a circumferential direction of the developing shutter 45. In the state where the drum cartridge 4 and the toner cartridge 5 are mounted in the main body housing 2, the protrusion 542 of the toner shutter 54 is fitted to the hole 452. Thereby, in the state where the drum cartridge 4 and the toner cartridge 5 are mounted in the main body housing 2, the developing shutter 45 is engaged with the toner cartridge 5. In the state where the drum cartridge 4 and the toner cartridge 5 are mounted in the main body housing 2, the developing shutter 45 is engaged with the toner shutter 54. The developing shutter 45 is fixed to the toner cartridge 5 by being engaged with the toner shutter 54 of the toner cartridge 5.

"The developing shutter 45 is fixed to the toner cartridge 5" means that the developing shutter 45 does not move in the second direction D with respect to the toner cartridge 5 even when the developing housing 432 moves in the second direction D with respect to the photosensitive drum 41.

The developing shutter 45 is supported by the drum frame 44 so as not to move in the second direction D, and the toner housing 51 of the toner cartridge 5 is also fixed to the drum frame 44. As a result, the developing shutter 45 does not move in the second direction D with respect to the toner cartridge 5 even when the developing housing 432 moves in the second direction D with respect to the photosensitive drum 41.

Therefore, even when the developing housing 432 moves in the second direction D with respect to the photosensitive drum 41 in the state where the drum cartridge 4 and the toner cartridge 5 are mounted in the main body housing 2, the developing shutter 45 is located at the developing open position, and the toner shutter 54 is located at the toner open position, a change in a position of the developing shutter opening 451 with respect to the toner discharge port 511 in the second direction D can be reduced.

As a result, in a configuration in which the toner is supplied from the toner cartridge 5 to the developing housing 432 movable with respect to the photosensitive drum 41, leakage of the toner supplied from the toner cartridge 5 to the developing housing 432 can be further prevented.

In the state where the developing shutter 45 is fixed to the toner cartridge 5, the developing shutter 45 is rotatable about the axis A5 together with the toner shutter 54. In other words, in the state where the developing shutter 45 is engaged with the toner cartridge 5, the developing shutter 45 moves from the developing closed position to the developing open position in conjunction with movement of the toner shutter 54 from the toner closed position to the toner open position, and moves from the developing open position to the developing closed position in conjunction with movement of the toner shutter 54 from the toner open position to the toner closed position.

3.6 Seal Member 49

As shown in FIG. 12, in the state where the toner shutter 54 is located at the toner open position and the developing shutter 45 is located at the developing open position, the seal member 49 seals between the developing shutter 45 and the receiving portion 516 together with the seal member 52. The seal member 49 is located on the circumferential surface of the developing shutter 45. The seal member 49 may be attached to the developing shutter 45 with an adhesive or the like. The seal member 49 surrounds the developing shutter opening 451. In FIGS. 7 to 11, the seal member 49 is omitted for convenience.

3.7 Cushion Member 46

The cushion member 46 is located between the tubular portion 4322 of the developing housing 432 and the developing shutter 45.

3.7.1 Material of Cushion Member 46

The cushion member 46 is made of an elastic material. In the present embodiment, the cushion member 46 is made of sponge. The cushion member 46 is located between the tubular portion 4322 and the developing shutter 45 in a slightly compressed state.

In a case where the developing housing 432 moves with respect to the photosensitive drum 41 in the state where the drum cartridge 4 and the toner cartridge 5 are mounted in the main body housing 2, the developing shutter 45 is located at the developing open position, and the toner shutter 54 is located at the toner open position, the tubular portion 4322 of the developing housing 432 moves with respect to the developing shutter 45 in a state where the developing shutter 45 is fixed to the side plate 44B. At this time, the cushion member 46 is deformed elastically.

Specifically, in a case where the developing housing 432 moves in a direction away from the photosensitive drum 41, the tubular portion 4322 moves in a direction away from the photosensitive drum 41. On the other hand, since the developing shutter 45 is fixed to the side plate 44B, the developing shutter 45 does not move.

Then, a portion P1 of the cushion member 46 located between the photosensitive drum 41 and the tubular portion 4322 is restored from the compressed state and fills a gap between the developing shutter 45 and the tubular portion 4322. On the other hand, a portion P2 of the cushion member 46 located on a side opposite to the photosensitive drum 41 with respect to the tubular portion 4322 is compressed between the developing shutter 45 and the tubular portion 4322.

In a case where the developing housing 432 moves toward the photosensitive drum 41, the portion P1 of the cushion member 46 located between the photosensitive drum 41 and the tubular portion 4322 is compressed between the developing shutter 45 and the tubular portion 4322. On the other hand, the portion P2 of the cushion member 46 located on the side opposite to the photosensitive drum 41 with respect to the tubular portion 4322 is restored from the compressed state and fills the gap between the developing shutter 45 and the tubular portion 4322.

In this way, in a case where the developing housing 432 moves with respect to the photosensitive drum 41 in the state where the drum cartridge 4 and the toner cartridge 5 are mounted in the main body housing 2, the developing shutter 45 is located at the developing open position, and the toner shutter 54 is located at the toner open position, the cushion member 46 allows the tubular portion 4322 of the developing housing 432 to move with respect to the developing shutter 45 in a state where the developing shutter 45 is engaged with the toner cartridge 5.

3.7.2 Arrangement and Shape of Cushion Member 46

In the present embodiment, the cushion member 46 has a cylindrical shape. The cushion member 46 is located between the side wall 43211 and the side plate 44B in the first direction (see FIG. 6). The cushion member 46 has a first surface S51 and a second surface S52.

The first surface S51 is an inner surface of the cushion member 46. The first surface S51 comes into contact with a circumferential surface of the tubular portion 4322 of the developing housing 432. In other words, the cushion member 46 comes into contact with the tubular portion 4322. The cushion member 46 may be attached to the circumferential surface of the tubular portion 4322 with an adhesive or the like.

The second surface S52 is an outer surface of the cushion member 46. The second surface S52 comes into contact with an inner surface of the developing shutter 45. Accordingly, the cushion member 46 supports the developing shutter 45. When the developing shutter 45 moves between the developing closed position and the developing open position, the developing shutter 45 slides on the second surface S52 while being in contact with the second surface S52.

The cushion member 46 does not cover the toner receiving port 433. Accordingly, the cushion member 46 allows the toner receiving port 433 to receive the toner. The cushion member 46 surrounds the toner receiving port 433. As shown in FIG. 11, the cushion member 46 surrounding the toner receiving port 433 is in contact with the circumferential surface of the tubular portion 4322 at the first surface S51 and is in contact with the inner surface of the developing shutter 45 at the second surface S52, whereby the cushion member 46 seals between the tubular portion 4322 of the developing housing 432 and the developing shutter 45 in the state where the developing shutter 45 is located at the developing closed position. Accordingly, the leakage of the toner from between the developing housing 432 and the developing shutter 45 can be prevented.

4. Operational Effects of First Embodiment (1) According to the image forming apparatus 1, as shown in FIG. 12, the cushion member 46 is located between the tubular portion 4322 of the developing housing 432 and the developing shutter 45.

Therefore, in the case where the developing housing 432 moves with respect to the photosensitive drum 41 in the state where the drum cartridge 4 and the toner cartridge 5 are mounted in the main body housing 2, the developing shutter 45 is located at the developing open position, and the toner shutter 54 is located at the toner open position, the developing housing 432 can move with respect to the developing shutter 45 in the state where the developing shutter 45 is supported by the drum frame 44 so as not to move in the second direction D and is engaged with the toner cartridge 5.

Accordingly, even in a case where the developing housing 432 moves with respect to the photosensitive drum 41, a change in a position of the developing shutter 45 with respect to the toner cartridge 5 can be reduced.

As a result, in the configuration in which the toner is supplied from the toner cartridge 5 to the developing housing 432 movable with respect to the photosensitive drum 41, the leakage of the toner supplied from the toner cartridge 5 to the developing housing 432 can be prevented.

(2) According to the image forming apparatus 1, as shown in FIG. 11, the developing shutter 45 has the developing shutter opening 451. In the state where the developing shutter 45 is located at the developing closed position, the developing shutter opening 451 does not communicate with the toner receiving port 433. On the other hand, as shown in FIG. 12, in the state where the developing shutter 45 is located at the developing open position, the developing shutter opening 451 communicates with the toner receiving port 433.

In the state where the drum cartridge 4 and the toner cartridge 5 are mounted in the main body housing 2, the developing shutter 45 is located at the developing open position, and the toner shutter 54 is located at the toner open position, the developing shutter opening 451 communicates with the toner discharge port 511.

Therefore, in the case where the developing housing 432 moves with respect to the photosensitive drum 41 in the state where the drum cartridge 4 and the toner cartridge 5 are mounted in the main body housing 2, the developing shutter 45 is located at the developing open position, and the toner shutter 54 is located at the toner open position, the change in the position of the developing shutter opening 451 with respect to the toner discharge port 511 can be reduced.

As a result, in the configuration in which the toner is supplied from the toner cartridge 5 to the developing housing 432 movable with respect to the photosensitive drum 41, the leakage of the toner supplied from the toner cartridge 5 to the developing housing 432 can be further prevented.

(3) According to the image forming apparatus 1, as shown in FIG. 11, in the state where the developing shutter 45 is located at the developing closed position, the cushion member 46 seals between the developing housing 432 and the developing shutter 45.

Therefore, the leakage of the toner from between the developing housing 432 and the developing shutter 45 can be prevented by the cushion member 46.

(4) According to the image forming apparatus 1, as shown in FIGS. 11 and 12, when the developing shutter 45 moves between the developing closed position (see FIG. 11) and the developing open position (see FIG. 12), the developing shutter 45 slides on the second surface S52 of the cushion member 46 while being in contact with the second surface S52.

Accordingly, when the developing shutter 45 moves between the developing closed position and the developing open position, the leakage of the toner from between the developing shutter 45 and the cushion member 46 can be prevented.

(5) According to the image forming apparatus 1, as shown in FIGS. 11 and 12, the developing shutter 45 extends in the first direction. The developing shutter 45 has the cylindrical shape.

Therefore, the developing shutter 45 can move between the developing closed position and the developing open position by being rotated.

Accordingly, the space where the developing shutter 45 moves can be reduced.

According to such configuration, even when the developing housing 432 moves with respect to the photosensitive drum 41, the developing housing 432 does not interfere with the developing shutter 45.

(6) According to the image forming apparatus 1, as shown in FIGS. 9 and 10, the toner cartridge 5 includes the handle 55 for moving the toner shutter 54.

Therefore, the user can easily move the toner shutter 54 by operating the handle 55.

(7) According to the image forming apparatus 1, as shown in FIG. 12, in the state where the drum cartridge 4 and the toner cartridge 5 are mounted in the main body housing 2, the toner discharge port 511 is located above the toner receiving port 433.

Therefore, even when the cushion member 46 is thick, the toner in the toner cartridge 5 can be supplied to the developing device 43 using gravity.

(8) According to the image forming apparatus 1, as shown in FIG. 10, in the state where the toner cartridge 5 is mounted on the drum cartridge 4, the developing shutter 45 is located at the developing open position, and the toner shutter 54 is located at the toner open position, the toner cartridge 5 is locked to the drum cartridge 4.

Accordingly, the detachment of the toner cartridge 5 from the drum cartridge 4 can be prevented in the state where the developing shutter 45 is located at the developing open position and the toner shutter 54 is located at the toner open position.

5. Second Embodiment

Hereinafter, a second embodiment will be described with reference to FIGS. 13 to 18. In the second embodiment, the same members as those in the first embodiment are denoted by the same reference numerals, and description thereof will be omitted.

Figure 13:
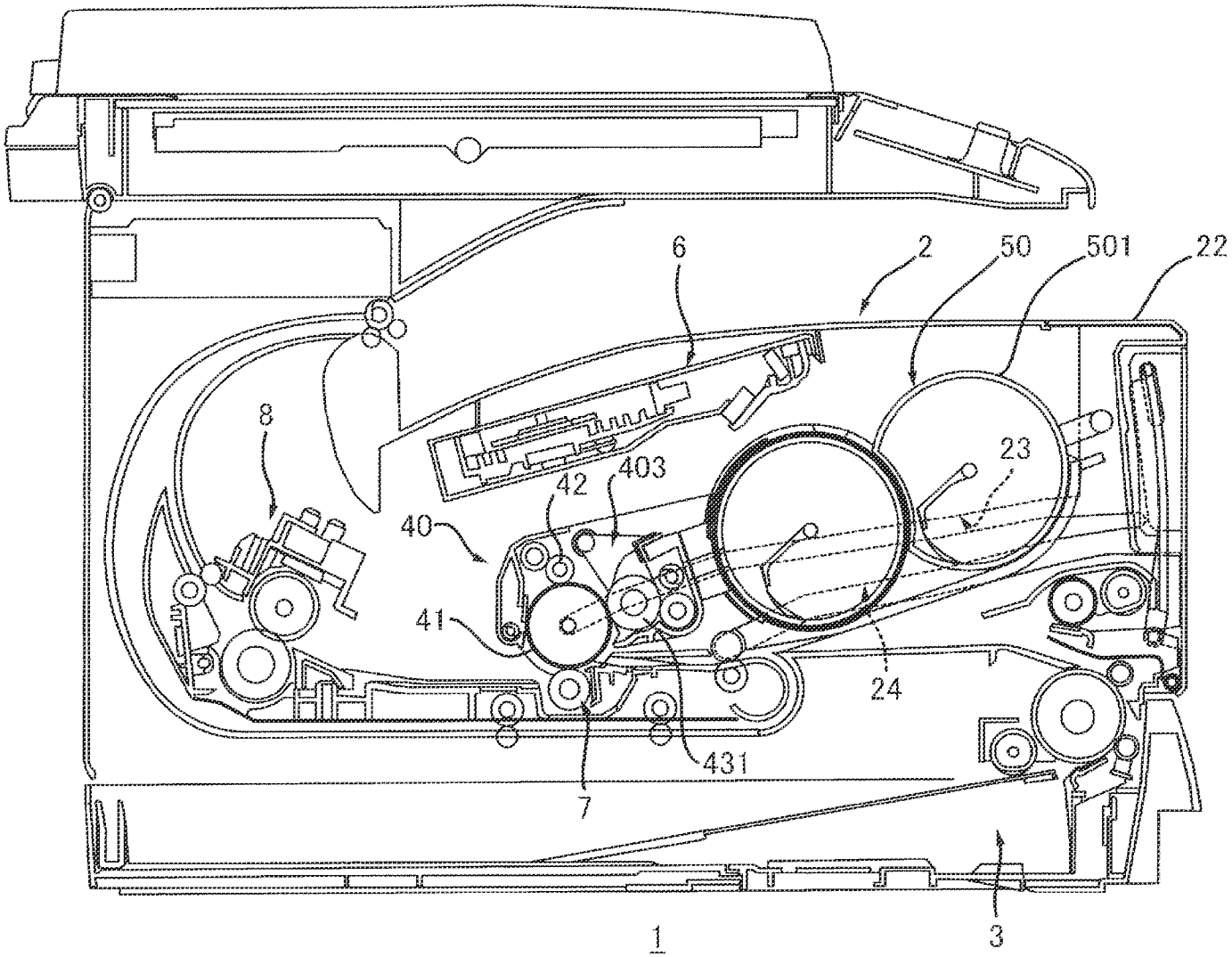
FIG. 13 is a schematic configuration view of an image forming apparatus according to a second embodiment.

As shown in FIG. 13, the image forming apparatus 1 includes the above-described main body housing 2, the above-described sheet cassette 3, the above-described exposure device 6, the above-described transfer device 7, the above-described fixing device 8, a drum cartridge 40 and a toner cartridge 50.

The drum cartridge 40 is mountable in the main body housing 2. The toner cartridge 50 is mountable on the drum cartridge 40. The toner cartridge 50 is mounted in the main body housing 2 by mounting the drum cartridge 40 in the main body housing 2 in the state where the toner cartridge 50 is mounted on the drum cartridge 40.

5.1 Details of Toner Cartridge 50

Next, the toner cartridge 50 will be described in detail with reference to FIGS. 14, 15A and 15B.

Figure 14:
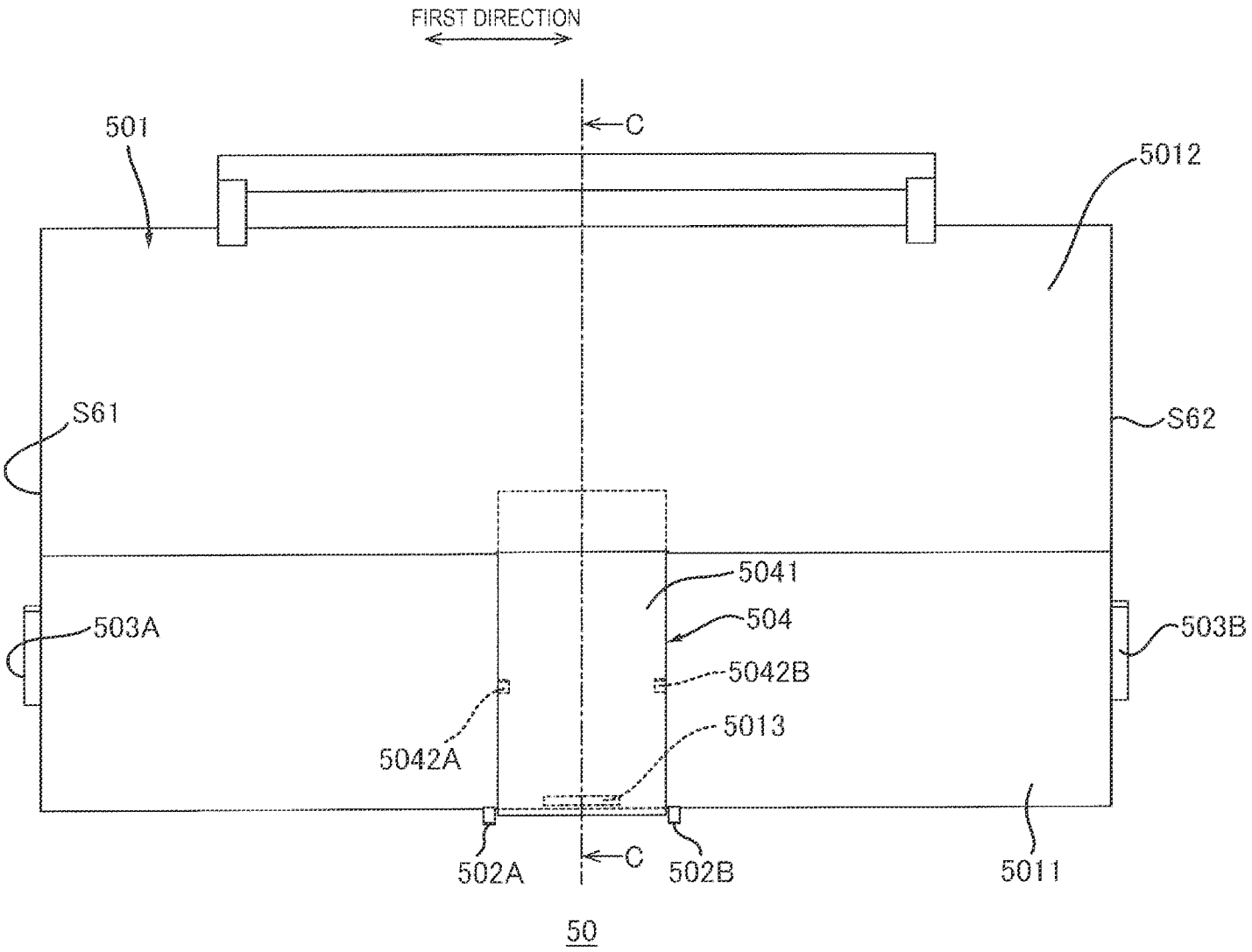
FIG. 14 is a plan view of a toner cartridge shown in FIG. 13.

As shown in FIG. 14, the toner cartridge 50 includes a toner housing 501, a toner shutter 504, two first protrusions 502A, 502B and two second protrusions 503A, 503B.

5.1.1 Toner Housing 501

The toner housing 501 extends in a first direction. The toner housing 501 has one side surface S61 in the first direction and the other side surface S62 in the first direction.

Figure 15A:
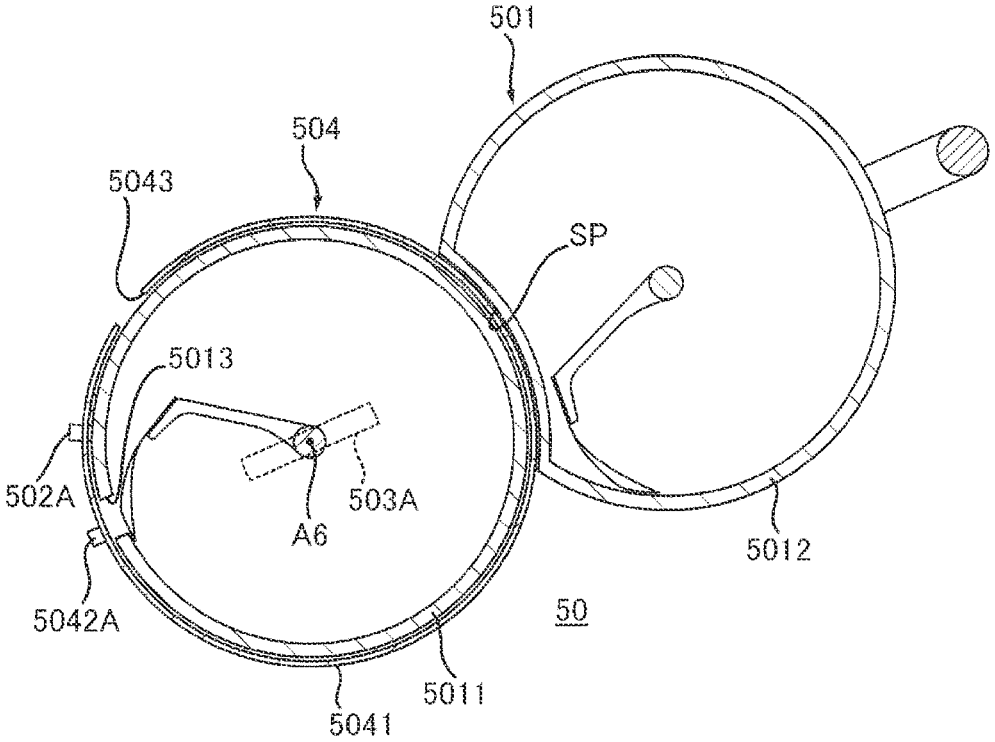
FIG. 15A is a cross-sectional view of the toner cartridge shown in FIG. 14 taken along a line C-C, which shows a state where a toner shutter is located at a toner closed position.

As shown in FIG. 15A, the toner housing 501 is capable of accommodating toner. The toner housing 501 includes a first toner accommodating portion 5011 and a second toner accommodating portion 5012.

The first toner accommodating portion 5011 extends in the first direction. The first toner accommodating portion 5011 has a cylindrical shape. An axis A6 of the first toner accommodating portion 5011 extends in the first direction.

The second toner accommodating portion 5012 is arranged next to the first toner accommodating portion 5011 in a direction intersecting the first direction. The second toner accommodating portion 5012 extends in the first direction. The second toner accommodating portion 5012 has a cylindrical shape. The second toner accommodating portion 5012 is connected to the first toner accommodating portion 5011 except for a central portion in the first direction. An internal space of the first toner accommodating portion 5011 communicates with an internal space of the second toner accommodating portion 5012 at a connecting portion between the first toner accommodating portion 5011 and the second toner accommodating portion 5012.

The central portion of the second toner accommodating portion 5012 in the first direction is not connected to a central portion of the first toner accommodating portion 5011 in the first direction. The central portion of the second toner accommodating portion 5012 in the first direction is located with a gap SP with respect to the central portion of the first toner accommodating portion 5011 in the first direction.

The toner housing 501 has a toner discharge port 5013. Specifically, the first toner accommodating portion 5011 has the toner discharge port 5013. The toner discharge port 5013 is located on a side opposite to the second toner accommodating portion 5012 with respect to the gap SP. The toner discharge port 5013 is located at a center of the first toner accommodating portion 5011 in the first direction.

5.1.2 Toner Shutter 504

Figure 15B:
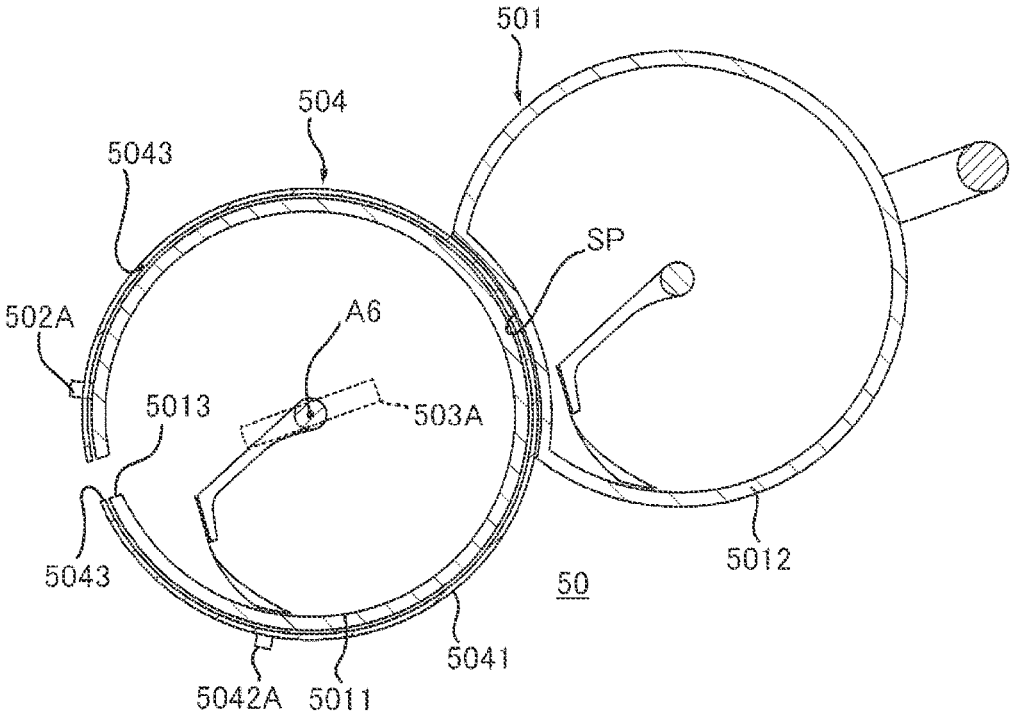
FIG. 15B is a cross-sectional view of the toner cartridge shown in FIG. 14 taken along the line C-C, which shows a state where the toner shutter is located at a toner open position.

The toner shutter 504 is movable between a toner closed position (see FIG. 15A) and a toner open position (see FIG. 15B). The toner shutter 504 is rotatable about the axis A6 between the toner closed position and the toner open position.

In the state where the toner shutter 504 is located at the toner closed position, the toner shutter 504 closes the toner discharge port 5013. As shown in FIG. 15B, in the state where the toner shutter 504 is located at the toner open position, the toner discharge port 5013 is opened.

As shown in FIG. 14, the toner shutter 504 includes a toner shutter main body 5041 and two protrusions 5042A, 5042B.

5.1.2.1 Toner Shutter Main body 5041

The toner shutter main body 5041 extends in the first direction. The toner shutter main body 5041 has a cylindrical shape. In other words, the toner shutter 504 has a cylindrical shape.

The toner shutter main body 5041 is located on a circumferential surface of the first toner accommodating portion 5011. As shown in FIG. 15A, the first toner accommodating portion 5011 is located on an inner side of the toner shutter main body 5041. The toner shutter main body 5041 passes through the gap SP.

The toner shutter main body 5041 has a toner shutter opening 5043. In the state where the toner shutter 504 is located at the toner closed position, the toner shutter opening 5043 is located away from the toner discharge port 5013. In the state where the toner shutter 504 is located at the toner closed position, the entire toner shutter opening 5043 does not communicate with the toner discharge port 5013. In the state where the toner shutter 504 is located at the toner closed position, the toner discharge port 5013 is closed by the toner shutter main body 5041. Accordingly, the toner in the first toner accommodating portion 5011 is not discharged.

On the other hand, as shown in FIG. 15B, in the state where the toner shutter 504 is located at the toner open position, at least a part of the toner shutter opening 5043 communicates with the toner discharge port 5013. Accordingly, the toner in the first toner accommodating portion 5011 is discharged through the toner discharge port 5013 and the toner shutter opening 5043.

5.1.2.2 Protrusions 5042A, 5042B

As shown in FIGS. 14 and 15A, the protrusion 5042A is located on a circumferential surface of the toner shutter main body 5041. The protrusion 5042A is located away from the toner shutter opening 5043 in a circumferential direction of the toner shutter main body 5041. The protrusion 5042A protrudes from the toner shutter main body 5041 in a radial direction of the toner shutter main body 5041. The protrusion 5042A may be attached to the toner shutter main body 5041.

The protrusion 5042B is located on the circumferential surface of the toner shutter main body 5041. The protrusion 5042B is spaced apart from the protrusion 5042A in the first direction. The protrusion 5042B protrudes from the toner shutter main body 5041 in the radial direction of the toner shutter main body 5041. The protrusion 5042B may be attached to the toner shutter main body 5041.

Figure 17:
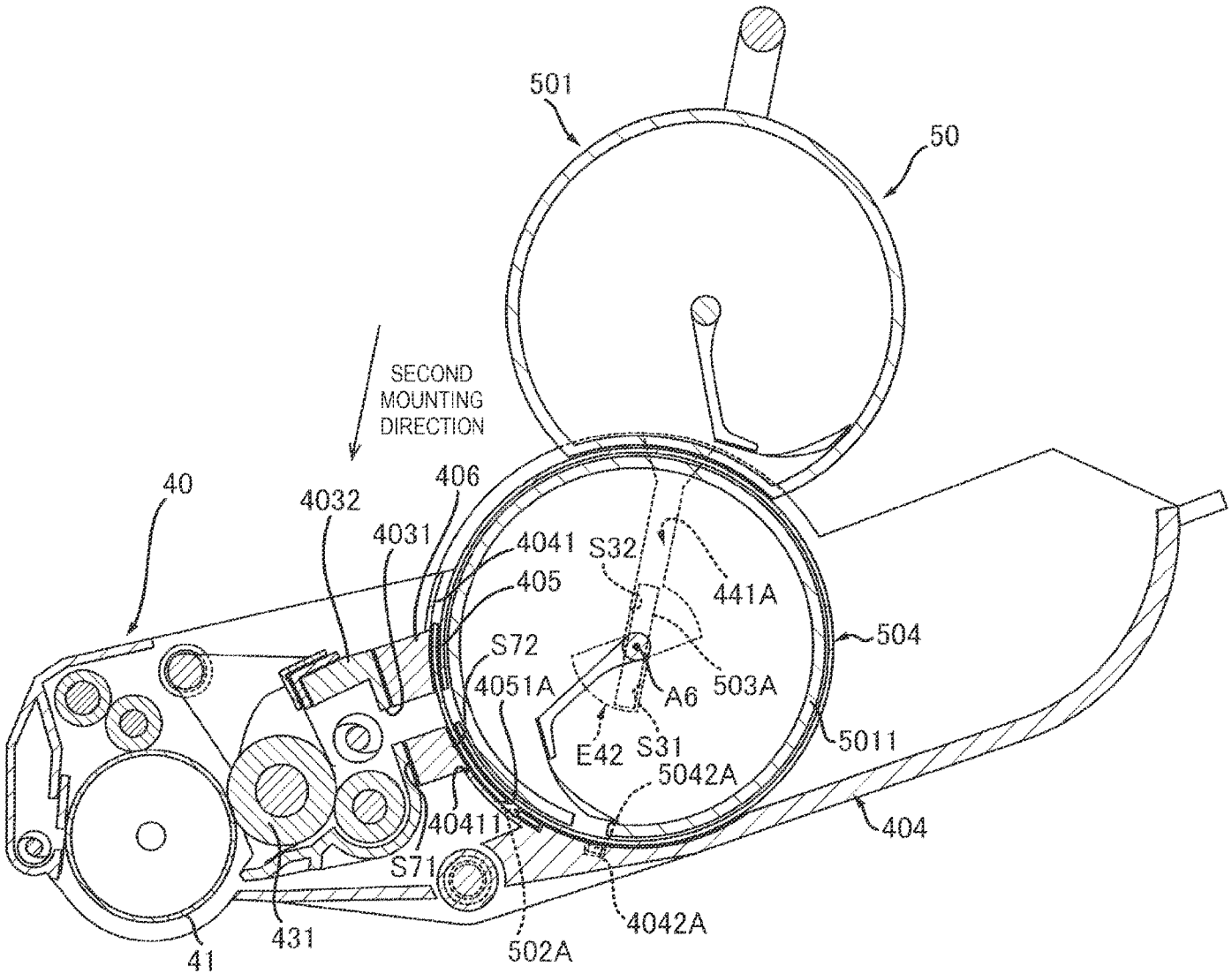
FIG. 17 shows a state where the toner cartridge shown in FIG. 14 is mounted on the drum cartridge, a developing shutter is located at a developing closed position, and the toner shutter is located at the toner closed position.

As shown in FIG. 17, in the state where the toner cartridge 50 is mounted on the drum cartridge 40, the protrusion 5042A is fitted to a groove 4042A of a drum frame 404, and the protrusion 5042B is fitted to a groove 4042B of the drum frame 404. The grooves 4042A, 4042B will be described later.

Thereby, in the state where the toner cartridge 50 is mounted on the drum cartridge 40, the toner shutter 504 is engaged with the drum frame 404. Therefore, in the state where the drum cartridge 40 and the toner cartridge 50 are mounted in the main body housing 2, the toner shutter 504 is fixed to the drum frame 404.

"The toner shutter 504 is fixed to the drum frame 404" describes a state where the toner shutter 504 does not move with respect to the drum frame 404 when the toner housing 501 rotates with respect to the drum frame 404.

Figure 18:
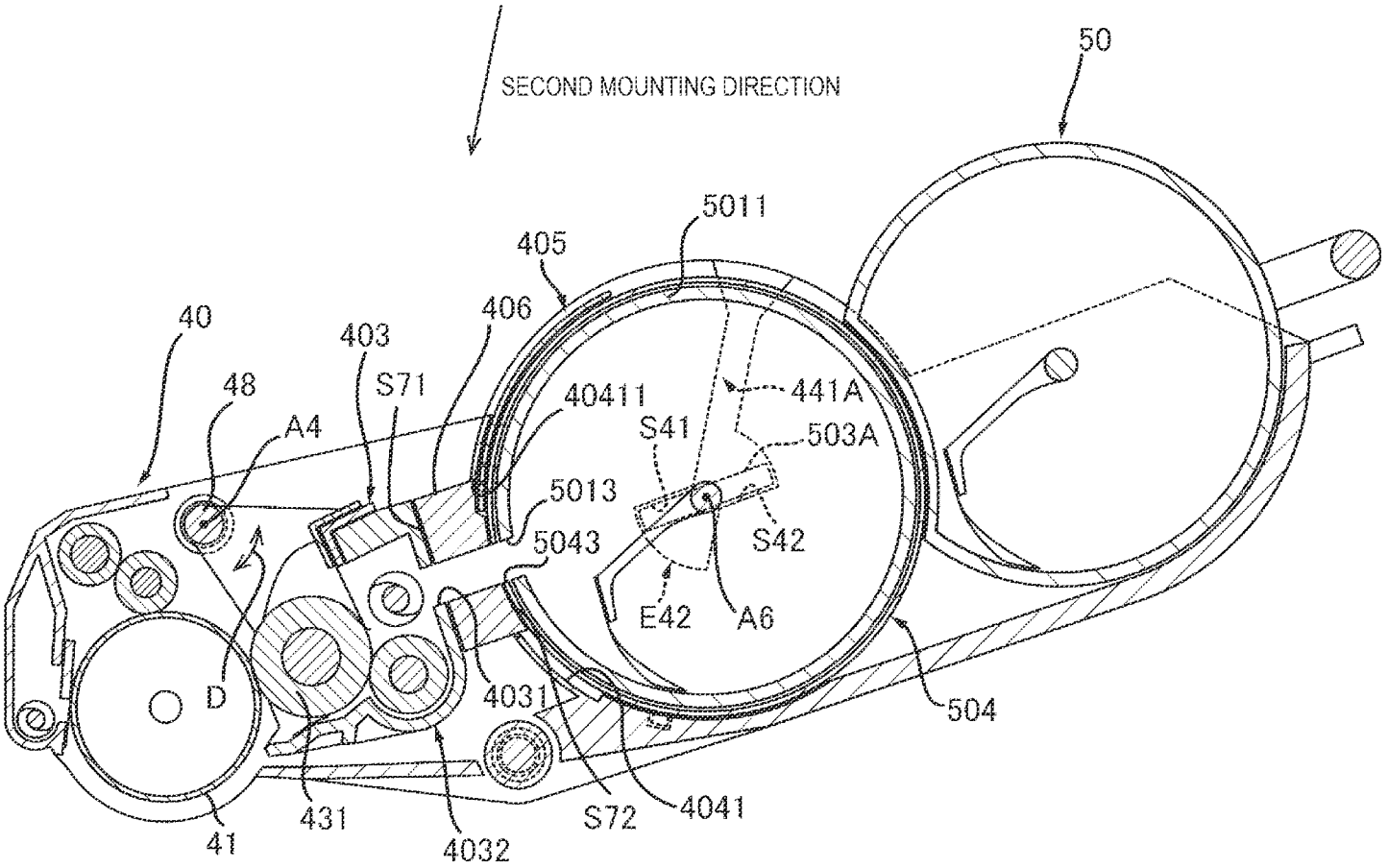
FIG. 18 shows a state where the toner cartridge shown in FIG. 14 is mounted on the drum cartridge, the developing shutter is located at a developing open position, and the toner shutter is located at the toner open position.

Therefore, as shown in FIGS. 17 and 18, when the toner housing 501 is rotated about the axis A6 in a state where the toner shutter 504 is engaged with the drum frame 404, the first toner accommodating portion 5011 rotates with respect to the toner shutter 504. Thereby, the toner shutter 504 moves between a state where the toner shutter 504 is located at the toner closed position (see FIG. 17) and a state where the toner shutter 504 is located at the toner open position (see FIG. 18).

5.1.2.3 First Protrusions 502A, 502B

As shown in FIG. 14, the first protrusion 502A is located on the circumferential surface of the first toner accommodating portion 5011. The first protrusion 502A is located on a side opposite to the second toner accommodating portion 5012 with respect to the first toner accommodating portion 5011. The first protrusion 502A is located between the toner shutter main body 5041 and the side surface S61 in the first direction. The first protrusion 502A protrudes from the circumferential surface of the first toner accommodating portion 5011 in a radial direction of the first toner accommodating portion 5011.

The first protrusion 502B is located on the circumferential surface of the first toner accommodating portion 5011. The first protrusion 502B is located on the side opposite to the second toner accommodating portion 5012 with respect to the first toner accommodating portion 5011. The first protrusion 502B is located on a side opposite to the first protrusion 502A with respect to the toner shutter main body 5041 in the first direction. The first protrusion 502A protrudes from the circumferential surface of the first toner accommodating portion 5011 in the radial direction of the first toner accommodating portion 5011.

Figure 16:
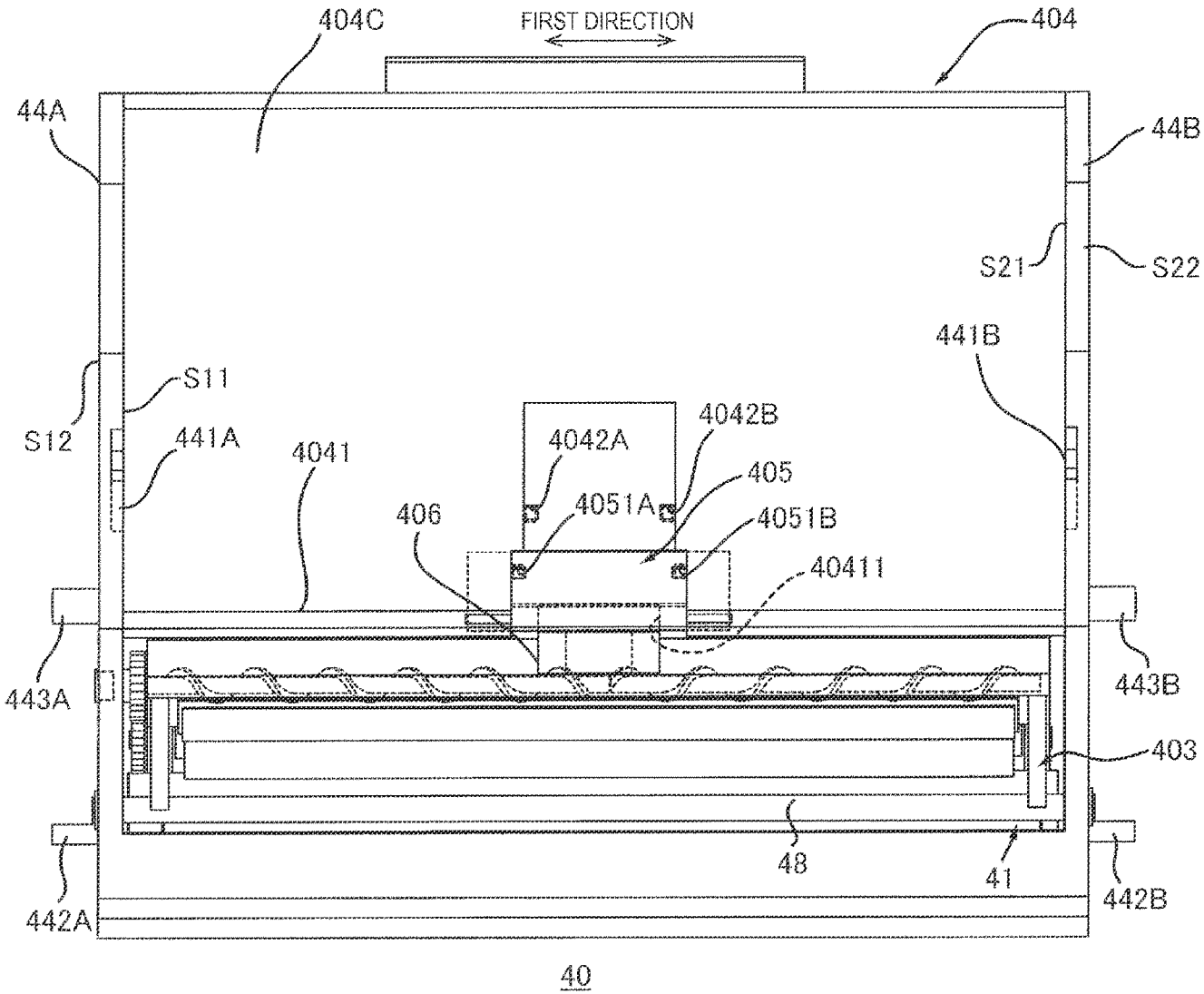
FIG. 16 is a plan view of a drum cartridge shown in FIG. 13.

As shown in FIGS. 17 and 18, in the state where the toner cartridge 50 is mounted on the drum cartridge 40, the second protrusion 503A is fitted to a hole 4051A of a developing shutter 405, and the second protrusion 503B is fitted to a hole 4051B of the developing shutter 405 (see FIG. 16). The holes 4051A, 4051B will be described later.

5.1.2.4 Second Protrusions 503A, 503B

As shown in FIG. 14, the second protrusion 503A is located on the side surface S61 of the toner housing 501. The second protrusion 503A is arranged next to the first toner accommodating portion 5011 in the first direction. The second protrusion 503A protrudes from the side surface S61 in the first direction. The second protrusion 503A extends in a direction in which the first toner accommodating portion 5011 and the second toner accommodating portion 5012 are arranged next to each other. The second protrusion 503A may be attached to the side surface S61.

The second protrusion 503B is located on the side surface S62 of the toner housing 501. The second protrusion 503B is located on aside opposite to the second protrusion 503A with respect to the first toner accommodating portion 5011. The second protrusion 503B protrudes from the side surface S62 in the first direction. The second protrusion 503B extends in a direction in which the first toner accommodating portion 5011 and the second toner accommodating portion 5012 are arranged next to each other. The second protrusion 503B may be attached to the side surface S62.

As shown in FIGS. 17 and 18, in the state where the toner cartridge 50 is mounted on the drum cartridge 40, the second protrusion 503A is fitted to the second end portion E42 of the guide 441A. In the state where the second protrusion 503A is fitted to the second end portion E42, the second end portion E42 allows the toner housing 501 to rotate about the axis A6.

As shown in FIG. 17, in a state where the toner cartridge 50 is mounted on the drum cartridge 40 and the toner shutter 504 is located at the toner closed position, the second protrusion 503A extends in a second mounting direction and faces the first guide surface S31 and the second guide surface S32 in a direction intersecting with the second mounting direction. Therefore, in the state where the toner cartridge 50 is mounted on the drum cartridge 40 and the toner shutter 504 is located at the toner closed position, the toner cartridge 50 is detachable from the drum cartridge 40 along the guide 441A.

As shown in FIG. 18, in a state where the toner cartridge 50 is mounted on the drum cartridge 40 and the toner shutter 504 is located at the toner open position, the second protrusion 503A extends in the direction intersecting with the second mounting direction and faces the first lock surface S41 and the second lock surface S42 in the second mounting direction. Thereby, the toner cartridge 50 is locked to the drum cartridge 40 in the state where the toner cartridge 50 is mounted on the drum cartridge 40 and the toner shutter 504 is located at the toner open position. In the state where the toner cartridge 50 is locked to the drum cartridge 40, the toner cartridge 50 cannot move in the second mounting direction with respect to the drum cartridge 40.

Therefore, detachment of the toner cartridge 50 from the drum cartridge 40 can be prevented in the state where the toner shutter 504 is located at the toner open position.

5.2 Drum Cartridge 40

The drum cartridge 40 will be described in detail with reference to FIGS. 16 to 18.

As shown in FIG. 16, the drum cartridge 40 includes the above-described photosensitive drum 41, the above-described shaft 48, the drum frame 404, a developing device 403, the developing shutter 405, and a cushion member 406.

5.2.1 Drum Frame 404

The drum frame 404 includes the above-described side plate 44A, the above-described side plate 44B, the above-described protrusions 442A, 442B, the above-described protrusions 443A, 443B, a bottom plate 404C and a receiving portion 4041.

5.2.1.1 Bottom Plate 404C

The bottom plate 404C is located between the side plate 44A and the side plate 44B in the first direction. The bottom plate 404C extends in the first direction. One end portion of the bottom plate 404C in the first direction is connected to the side plate 44A. The other end portion of the bottom plate 404C in the first direction is connected to the side plate 44B.

The bottom plate 404C has the two grooves 4042A, 4042B. The groove 4042A is spaced apart from the groove 4042B in the first direction.

5.2.1.2 Receiving Portion 4041

As shown in FIG. 18, in the state where the toner cartridge 50 is mounted on the drum cartridge 40, the receiving portion 4041 receives the toner shutter 504 via the developing shutter 405. The receiving portion 4041 is located on a side opposite to the photosensitive drum 41 with respect to the developing device 403. The receiving portion 4041 is located between the developing device 403 and the second end portion E42 of the guide 441A.

The receiving portion 4041 is located between the side plate 44A and the side plate 44B in the first direction. The receiving portion 4041 extends in the first direction. One end portion of the receiving portion 4041 in the first direction is connected to the side plate 44A. The other end portion of the receiving portion 4041 in the first direction is connected to the side plate 44B. The receiving portion 4041 extends from the bottom plate 404C in a moving direction of the developing shutter 405. The receiving portion 4041 has an arc shape. The receiving portion 4041 has an opening 40411. The opening 40411 is located at a center of the receiving portion 4041 in the first direction.

5.2.2 Developing Device 403

The developing device 403 is located between the photosensitive drum 41 and the receiving portion 4041. The developing device 403 includes the above-described developing roller 431 and a developing housing 4032.

5.2.2.1 Developing Housing 4032

The developing housing 4032 supports the developing roller 431. The developing housing 4032 is connected to the shaft 48. Therefore, the developing housing 4032 is rotatable about the axis A4 of the shaft 48. In other words, the developing housing 4032 is movable with respect to the photosensitive drum 41 in the second direction D that is a rotation direction.

The developing housing 4032 has a toner receiving port 4031. In the state where the drum cartridge 40 and the toner cartridge 50 are mounted in the main body housing 2, the toner receiving port 4031 can receive the toner discharged from the toner discharge port 5013.

5.2.3 Developing Shutter 405

The developing shutter 405 is movable between a developing closed position (see FIG. 17) and a developing open position (see FIG. 18). As shown in FIG. 17, in the state where the developing shutter 405 is located at the developing closed position, the developing shutter 405 closes the toner receiving port 4031. As shown in FIG. 18, in the state where the developing shutter 405 is located at the developing open position, the toner receiving port 4031 is opened.

The developing shutter 405 is located on aside opposite to the developing device 403 with respect to the receiving portion 4041. The developing shutter 405 is movable along the receiving portion 4041. The developing shutter 405 is located at a center of the receiving portion 4041 in the first direction. The developing shutter 405 extends in the first direction and in an arc shape. The developing shutter 405 has a plate shape.

As shown in FIG. 16, the developing shutter 405 has two holes 4051A. 4051B. The hole 4051A is spaced apart from the hole 4051B in the first direction.

As shown in FIGS. 17 and 18, in the state where the toner cartridge 50 is mounted on the drum cartridge 40, the first protrusion 502A is fitted to the hole 4051A and the first protrusion 502B is fitted to the hole 4051B (see FIG. 16). Thereby, in the state where the drum cartridge 40 and the toner cartridge 50 are mounted in the main body housing 2, the developing shutter 405 is engaged with the toner cartridge 50. In the state where the drum cartridge 40 and the toner cartridge 50 are mounted in the main body housing 2, the developing shutter 405 is engaged with the toner housing 501. Due to the developing shutter 405 being engaged with the toner housing 501, the developing shutter 405 becomes movable together with the toner housing 501.

Therefore, when the toner housing 501 rotates about the axis A6 in the state where the toner cartridge 50 is mounted on the drum cartridge 40, the developing shutter 405 moves between the developing closed position and the developing open position together with rotation of the toner housing 501.

Specifically, when the toner housing 501 rotates in the state where the toner shutter 504 is engaged with the drum frame 44 and the developing shutter 405 is engaged with the toner housing 501, the developing shutter 405 moves from the developing closed position to the developing open position in conjunction with movement of the toner shutter 504 from the toner closed position to the toner open position, and moves from the developing open position to the developing closed position in conjunction with movement of the toner shutter 504 from the toner open position to the toner closed position.

As shown in FIG. 18, in the state where the drum cartridge 40 and the toner cartridge 50 are mounted in the main body housing 2, the developing shutter 405 is located at the developing open position, and the toner shutter 504 is located at the toner open position, the toner shutter opening 5043 communicates with the toner receiving port 4031. Accordingly, the toner discharged from the toner discharge port 5013 enters the developing housing 4032 through the toner shutter opening 5043 and the toner receiving port 4031.

5.2.4 Cushion Member 406

As shown in FIG. 17, in the state where the developing shutter 405 is located at the developing closed position, the cushion member 406 is located between the developing housing 4032 and the developing shutter 405. The cushion member 406 is made of an elastic material. In the present embodiment, the cushion member 406 is made of sponge. The cushion member 406 passes through the opening 40411 of the receiving portion 4041. The cushion member 406 has a first surface S71 and a second surface S72.

The first surface S71 is in contact with the developing housing 4032. The cushion member 406 may be attached to the developing housing 4032 with an adhesive or the like. In the state where the developing shutter 405 is located at the developing closed position, the second surface S72 is in contact with the developing shutter 405 through the opening 40411.

The cushion member 406 does not cover the toner receiving port 4031. Accordingly, the cushion member 406 allows the toner receiving port 4031 to receive the toner. The cushion member 406 surrounds the toner receiving port 4031. In the state where the developing shutter 405 is located at the developing closed position, the cushion member 406 surrounding the toner receiving port 4031 is in contact with the developing housing 4032 at the first surface S71 and is in contact with an inner surface of the developing shutter 405 at the second surface S72, whereby the cushion member 406 seals between the developing housing 4032 and the developing shutter 405.

On the other hand, as shown in FIG. 18, in the state where the toner cartridge 50 is mounted on the drum cartridge 40 and the developing shutter 405 is located at the developing open position, at least a part of the second surface S72 comes into contact with the toner shutter 504. In other words, in the state where the drum cartridge 40 and the toner cartridge 50 are mounted in the main body housing 2, the toner shutter 504 is located at the toner open position, and the developing shutter 405 is located at the developing open position, at least a part of the cushion member 406 is in contact with the toner shutter 504.

In the state where the cushion member 406 is in contact with the toner shutter 504, the cushion member 406 is located between the developing housing 4032 and the toner shutter 504 in a slightly compressed state.

When the developing housing 4032 moves with respect to the photosensitive drum 41 in a state where the drum cartridge 40 and the toner cartridge 50 are mounted in the main body housing 2, the developing shutter 405 is located at the developing open position, and the toner shutter 504 is located at the toner open position, the developing housing 4032 moves with respect to the developing shutter 405 in a state where the developing shutter 405 is fixed to the toner cartridge 50. At this time, the cushion member 406 is deformed elastically.

In other words, when the developing housing 4032 moves with respect to the photosensitive drum 41 in the state where the drum cartridge 40 and the toner cartridge 50 are mounted in the main body housing 2, the developing shutter 405 is located at the developing open position, and the toner shutter 504 is located at the toner open position, the cushion member 406 allows the developing housing 4032 to move with respect to the developing shutter 405 in a state where the developing shutter 405 is supported by the drum frame 404 so as not to move in the second direction D and is engaged with the toner cartridge 50.

In the state where the drum cartridge 40 and the toner cartridge 50 are mounted in the main body housing 2, the toner shutter 504 is located at the toner open position, and the developing shutter 405 is located at the developing open position, a part of the developing shutter 405 is located between the cushion member 406 and the toner shutter 54. Therefore, the developing shutter 405 can smoothly move from the developing open position to the developing closed position.

Also in the second embodiment, the same operational effect as those of the first embodiment can be obtained.

6. Modifications

Hereinafter, modifications will be described with reference to FIGS. 19 to 21C. In the following modifications, the same members as those in the above-described embodiment are denoted by the same reference numerals, and explanation thereof will be omitted.

Figure 19:
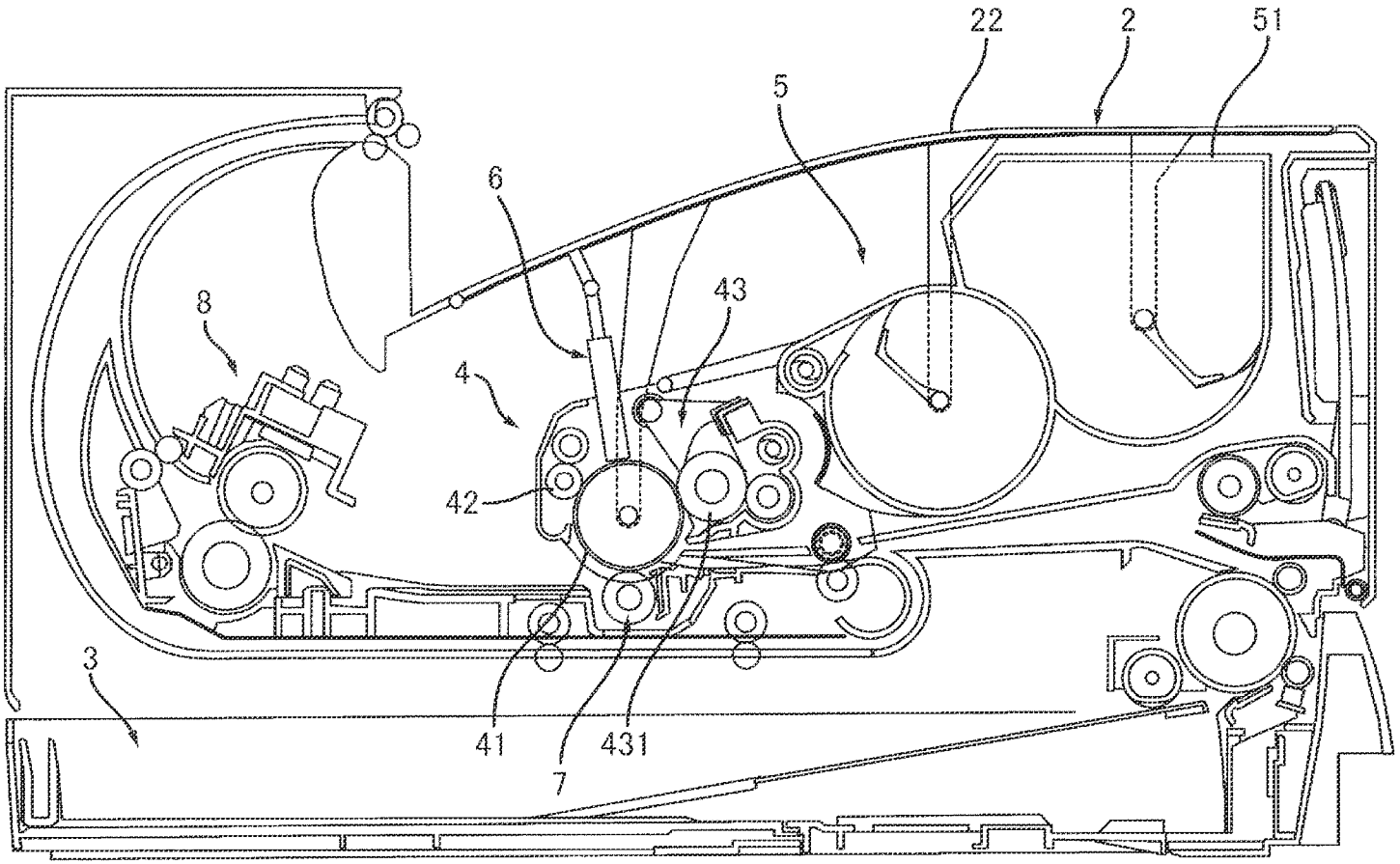
FIG. 19 is an explanatory view showing a first modification, which shows a state where a drum cartridge and a toner cartridge are mounted in a main body housing.
Figure 20:
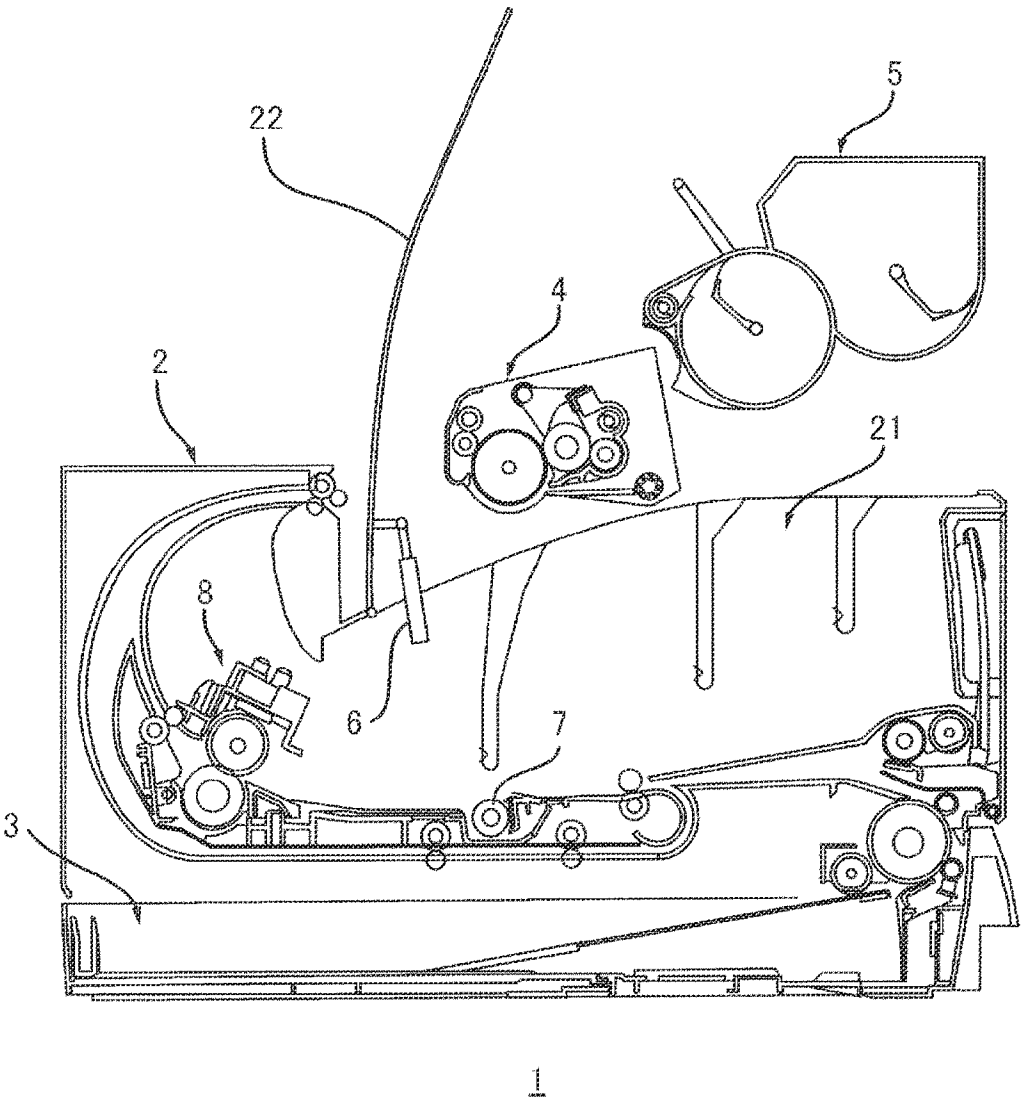
FIG. 20 shows a state where the drum cartridge and the toner cartridge are taken out of the main body housing.

(1) As shown in FIGS. 19 and 20, the toner cartridge 5 may be directly mounted in the main body housing 2 without being mounted on the drum cartridge 4. The opening 21 may be located in an upper wall of the main body housing 2. In the image forming apparatus 1 shown in FIGS. 19 and 20, the exposure device 6 is an LED head. The exposure device 6 may be supported by the cover 22.

Figure 21A:
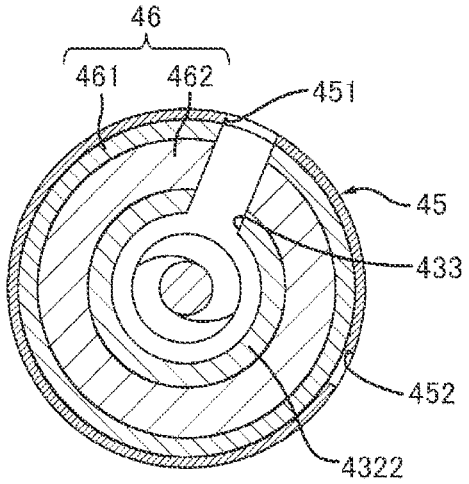
FIG. 21A is an explanatory view showing a second modification.

(2) The cushion member may include a first layer in contact with the developing shutter and a second layer located between the first layer and the developing housing. For example, as shown in FIG. 21A, the cushion member 46 may include a first layer 461 and a second layer 462.

The first layer 461 is located on an outer surface of the cushion member 46. The first layer 461 may be attached to the second layer 462 by an adhesive or the like. The first layer 461 is in contact with the developing shutter 45. The first layer 461 is made of, for example, a material such as a hard resin. When the developing housing 432 moves with respect to the photosensitive drum 41 in a state where the drum cartridge 4 and the toner cartridge 5 are mounted in the main body housing 2, the developing shutter 45 is located at the developing open position, and the toner shutter 54 is located at the toner open position, the first layer 461 does not deform. Accordingly, the first layer 461 can further prevent deformation of the cushion member 46 due to a frictional force caused by movement of the developing shutter 45.

The second layer 462 is located between the first layer 461 and the tubular portion 4322 of the developing housing 432. The second layer 462 may be attached to a circumferential surface of the tubular portion 4322 with an adhesive or the like. The second layer 462 is more flexible than the first layer 461. The second layer 462 is made of, for example, an elastic material such as sponge. When the developing housing 432 moves with respect to the photosensitive drum 41 in the state where the drum cartridge 4 and the toner cartridge 5 are mounted in the main body housing 2, the developing shutter 45 is located at the developing open position, and the toner shutter 54 is located at the toner open position, the second layer 462 is deformed elastically. Accordingly, the second layer 462 allows the developing shutter 45 to move.

Figure 21B:
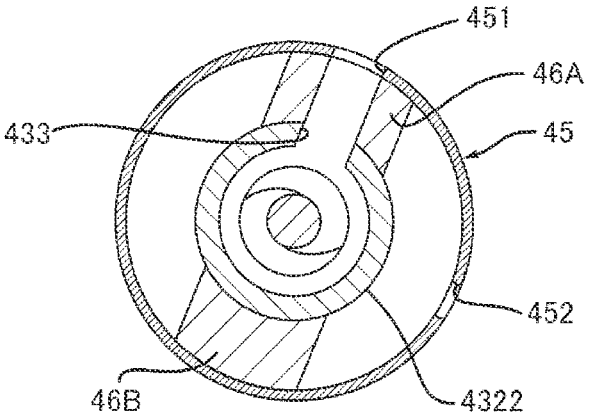
FIG. 21B is an explanatory view showing a third modification.

(3) The cushion member may not have a cylindrical shape. The drum cartridge may include a plurality of cushion members. For example, as shown in FIG. 21B, the drum cartridge 4 may include two cushion members 46A, 46B. The cushion member 46A surrounds the toner receiving port 433. The cushion member 46B is located on a side opposite to the cushion member 46A with respect to the tubular portion 4322. In this case, the cushion members 46A, 46B each have a rod shape extending in a first direction.

Figure 21C:
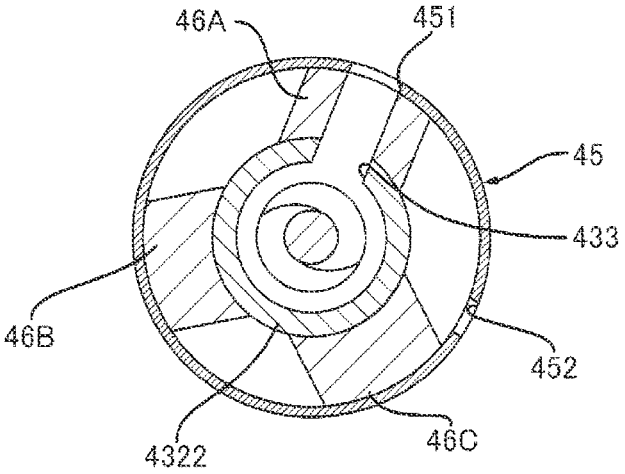
FIG. 21C is an explanatory view showing a fourth modification.

As shown in FIG. 21C, the drum cartridge 4 may include three cushion members 46A, 46B, 46C. The cushion member 46A surrounds the toner discharge port 511. The cushion members 46B, 46C are located away from the cushion member 46A in a circumferential direction of the tubular portion 4322. In this case, the cushion members 46A, 46B, 46C each have a rod shape extending in the first direction.

(4) The tubular portion 4322 may not have a cylindrical shape. The tubular portion 4322 may have a polygonal tubular shape such as a quadrangular shape, a hexagonal shape or an octagonal shape. In a case where the tubular portion 4322 has the polygonal tubular shape, the cushion member 46 may be a tube having a hole having a shape the same as an outer shape of the tubular portion 4322. In this case, the cushion member 46 may not be attached to the circumferential surface of the tubular portion 4322.

(5) The developing housing 432 may be slidable with respect to the photosensitive drum 41. In this case, a sliding direction of the developing housing 432 is the second direction.

What is claimed is:

1. An image forming apparatus comprising:

a main body housing;

a drum cartridge mountable in the main body housing, the drum cartridge including:

a photosensitive drum rotatable about a drum axis extending in a first direction;

a developing device capable of supplying toner to the photosensitive drum; and a drum frame supporting the photosensitive drum and the developing device; and a toner cartridge mountable in the main body housing, the toner cartridge being capable of supplying the toner to the developing device in a state where the drum cartridge and the toner cartridge are mounted in the main body housing, and the toner cartridge including:

a toner housing capable of accommodating the toner, the toner housing having a toner discharge port for discharging the toner in the toner housing; and a toner shutter movable between a toner closed position where the toner shutter closes the toner discharge port and a toner open position where the toner discharge port is opened, wherein the developing device includes:

a developing roller rotatable about a developing shaft extending in the first direction; and a developing housing supporting the developing roller and movable with respect to the photosensitive drum in a second direction intersecting with the first direction, the developing housing having a toner receiving port for receiving the toner discharged from the toner discharge port, wherein the drum cartridge further includes:

a developing shutter movable between a developing closed position where the developing shutter closes the toner receiving port and a developing open position where the toner receiving port is opened, the developing shutter being engaged with the toner cartridge in a state where the drum cartridge and the toner cartridge are mounted in the main body housing, and the developing shutter being supported by the drum frame; and a cushion member located between the developing housing and the developing shutter, and wherein in a case where the developing housing moves with respect to the photosensitive drum in a state where: the drum cartridge and the toner cartridge are mounted in the main body housing; the developing shutter is located at the developing open position; and the toner shutter is located at the toner open position, the cushion member allows the developing housing to move with respect to the developing shutter in a state where the developing shutter is engaged with the toner cartridge.

2. The image forming apparatus according to claim 1, wherein in the state where the developing shutter is engaged with the toner cartridge, the developing shutter moves from the developing closed position to the developing open position in conjunction with movement of the toner shutter from the toner closed position to the toner open position and moves from the developing open position to the developing closed position in conjunction with movement of the toner shutter from the toner open position to the toner closed position.

3. The image forming apparatus according to claim 1, wherein the developing shutter has a developing shutter opening that does not communicate with the toner receiving port in a state where the developing shutter is located at the developing closed position and communicates with the toner receiving port in a state where the developing shutter is located at the developing open position, and wherein in a state where the toner shutter is located at the toner open position, the toner discharge port communicates with the developing shutter opening.

4. The image forming apparatus according to claim 1, wherein in the state where the drum cartridge and the toner cartridge are mounted in the main body housing, the developing shutter is engaged with the toner shutter.

5. The image forming apparatus according to claim 1, wherein the cushion member surrounds the toner receiving port and seals between the developing housing and the developing shutter in a state where the developing shutter is located at the developing closed position.

6. The image forming apparatus according to claim 1, wherein the cushion member includes a first surface in contact with the developing housing and a second surface in contact with the developing shutter.

7. The image forming apparatus according to claim 6, wherein when the developing shutter moves between the developing closed position and the developing open position, the developing shutter slides on the second surface while being in contact with the second surface.

8. The image forming apparatus according to claim 1, wherein the developing shutter extends in the first direction, and wherein the drum frame supports one end portion of the developing shutter in the first direction.

9. The image forming apparatus according to claim 8, wherein the developing shutter has a cylindrical shape.

10. The image forming apparatus according to claim 9, wherein the developing housing includes a tubular portion having the toner receiving port and extending in the first direction, the tubular portion being located on an inner side of the developing shutter, and wherein the cushion member is in contact with the tubular portion.

11. The image forming apparatus according to claim 10, wherein the tubular portion is located at one end portion of the developing housing in the first direction.

12. The image forming apparatus according to claim 9, wherein the toner cartridge further includes a handle for moving the toner shutter.

13. The image forming apparatus according to claim 8, wherein the developing shutter has a plate shape.

14. The image forming apparatus according to claim 13, wherein in the state where: the drum cartridge and the toner cartridge are mounted in the main body housing; the toner shutter is located at the toner open position; and the developing shutter is located at the developing open position, the cushion member is in contact with the toner shutter.

15. The image forming apparatus according to claim 13, wherein in the state where: the drum cartridge and the toner cartridge are mounted in the main body housing; the toner shutter is located at the toner open position; and the developing shutter is located at the developing open position, a part of the developing shutter is located between the cushion member and the toner shutter.

16. The image forming apparatus according to claim 13, wherein in the state where the drum cartridge and the toner cartridge are mounted in the main body housing, the toner shutter is fixed to the drum frame.

17. The image forming apparatus according to claim 1, wherein the cushion member includes a first layer in contact with the developing shutter and a second layer located between the first layer and the developing housing, and wherein the second layer is more flexible than the first layer.

18. The image forming apparatus according to claim 17, wherein in the case where the developing housing moves with respect to the photosensitive drum in the state where: the drum cartridge and the toner cartridge are mounted in the main body housing; the developing shutter is located at the developing open position; and the toner shutter is located at the toner open position, the first layer does not deform and the second layer deforms elastically.

19. The image forming apparatus according to claim 1, wherein in the state where the drum cartridge and the toner cartridge are mounted in the main body housing, the toner discharge port is located above the toner receiving port.

20. The image forming apparatus according to claim 1, wherein the toner cartridge is mountable on the drum cartridge, wherein the drum cartridge is mountable in the main body housing in a state where the toner cartridge is mounted on the drum cartridge, and wherein the toner cartridge is mounted in the main body housing by mounting the drum cartridge in the main body housing in the state where the toner cartridge is mounted on the drum cartridge.

21. The image forming apparatus according to claim 20, wherein the toner cartridge is positioned with respect to the drum cartridge in the state where the toner cartridge is mounted on drum cartridge, and wherein the drum cartridge is positioned with respect to the main body housing in a state where the drum cartridge is mounted in the main body housing.

22. The image forming apparatus according to claim 21, wherein in the state where: the toner cartridge is mounted on the drum cartridge; the developing shutter is located at the developing open position; and the toner shutter is located at the toner open position, the toner cartridge is locked to the drum cartridge.

* * * * *